US010562256B2

(12) United States Patent
Vassa et al.

(10) Patent No.: US 10,562,256 B2
(45) Date of Patent: Feb. 18, 2020

(54) METHODS FOR PRODUCING PRESSWARE

(71) Applicant: GPCP IP Holdings LLC, Atlanta, GA (US)

(72) Inventors: John Michael Vassa, Whitehall, PA (US); Keegan Tucker Schoch, Indiana, PA (US)

(73) Assignee: GPCP IP Holdings LLC, Atlanta, GA (US)

( * ) Notice: Subject to any disclaimer, the term of this patent is extended or adjusted under 35 U.S.C. 154(b) by 716 days.

(21) Appl. No.: 14/975,550

(22) Filed: Dec. 18, 2015

(65) Prior Publication Data

US 2016/0176146 A1 Jun. 23, 2016

Related U.S. Application Data

(60) Provisional application No. 62/095,152, filed on Dec. 22, 2014.

(51) Int. Cl.

| | |
|---|---|
| ***A47G 19/03*** | (2006.01) |
| ***B31D 5/02*** | (2017.01) |
| *B31B 50/59* | (2017.01) |

(52) U.S. Cl.

CPC ..... *B31D 5/02* (2013.01); *B31B 50/592* (2018.05)

(58) Field of Classification Search

CPC ... B31B 43/00; B31B 50/0012; B31B 50/592; B31D 5/02; B31D 2205/00; A47G 19/03; B65B 47/00; B65B 47/04; B65B 47/06; B31F 1/0077

See application file for complete search history.

(56) References Cited

U.S. PATENT DOCUMENTS

| | | | | |
|---|---|---|---|---|
| 1,645,931 A | | 10/1927 | Ruckert et al. | |
| 1,793,089 A | * | 2/1931 | Heyes | D21J 3/00 249/66.1 |
| 2,136,308 A | | 11/1938 | Miller | |

(Continued)

FOREIGN PATENT DOCUMENTS

| | | | |
|---|---|---|---|
| CN | 201442364 | U | 4/2010 |
| JP | 2006103136 | A | 4/2006 |
| KR | 2001-0032746 | A | 4/2001 |

OTHER PUBLICATIONS

International Search Report of International Application No. PCT/US2015/066747, mailed by the International Searching Authority dated Apr. 1, 2016.

(Continued)

*Primary Examiner* — Chelsea E Stinson
*Assistant Examiner* — Thomas M Wittenschlaeger

(57) ABSTRACT

Systems and methods for producing pressware are provided. In one or more embodiments, a method for producing pressware can include producing a pressware product between an upper forming die and a lower forming die contained within a forming die assembly, retracting at least a portion of the upper forming die from the pressware product, and ejecting the pressware product from the lower forming die while feeding a web material between the upper forming die and the lower forming die. The method can also include cutting a segment of the web material to produce a substrate, and pressing the substrate between the upper forming die and the lower forming die to produce another pressware product.

19 Claims, 23 Drawing Sheets

(56) References Cited

U.S. PATENT DOCUMENTS 2,296,744 A * 9/1942 Simmons ..... D21J 1/00 425/343
2,959,110 A 11/1960 Thoma
3,312,098 A * 4/1967 Henrickson ..... B21D 22/24 72/349
3,405,546 A 10/1968 Hoffman et al.
3,584,109 A 6/1971 Meadors et al.
3,695,084 A * 10/1972 Siemonsen ..... B21D 51/10 72/348
4,048,781 A * 9/1977 Johansen ..... B29C 51/18 264/322
4,228,121 A * 10/1980 Meadors ..... B29C 51/082 264/291
4,242,293 A 12/1980 Dowd
4,381,278 A * 4/1983 Ingraffea ..... B29C 51/082 264/512
4,416,133 A 11/1983 Doyle
4,442,691 A 4/1984 Grow et al.
4,516,420 A 5/1985 Bulso, Jr. et al.
4,534,725 A * 8/1985 Hemmelgarn ..... B31B 70/00 425/394
4,549,424 A * 10/1985 Bulso, Jr. ..... B21D 51/38 413/56
4,567,746 A * 2/1986 Bachmann ..... B21D 51/44 413/56
4,571,979 A 2/1986 Baba et al.
4,576,566 A * 3/1986 Hain ..... B31F 1/0077 425/400
4,587,826 A 5/1986 Bulso et al.
4,588,539 A * 5/1986 Rossi ..... B30B 1/261 264/40.5
4,755,128 A * 7/1988 Alexander ..... B29C 37/0007 249/66.1
4,800,743 A 1/1989 Bulso, Jr. et al.
4,832,676 A * 5/1989 Johns ..... B31F 1/0077 493/152
4,903,521 A 2/1990 Bulso, Jr. et al.
4,977,772 A 12/1990 Bulso, Jr. et al.
5,052,992 A 10/1991 Hyder
5,140,882 A 8/1992 Hyder
5,364,583 A * 11/1994 Hayashi ..... B29C 45/1703 264/335
5,881,593 A * 3/1999 Bulso, Jr. ..... B21D 22/24 72/336
5,904,643 A * 5/1999 Seeberger ..... B31B 70/00 493/59
6,032,505 A 3/2000 Stodd
6,527,687 B1 * 3/2003 Fortney ..... B26F 1/40 493/56
6,539,767 B2 4/2003 McClung
6,589,043 B1 * 7/2003 Johns ..... B29C 43/36 425/403.1
6,783,720 B2 8/2004 Johns et al.
7,165,437 B2 1/2007 Shin et al.
8,414,464 B2 4/2013 Grischenko et al.
8,430,660 B2 4/2013 Johns et al.
8,734,309 B2 * 5/2014 Johns ..... B31B 43/00 493/152
8,926,310 B2 1/2015 Irwin
9,011,308 B2 * 4/2015 Treccani ..... B31F 1/0077 493/174
2003/0205848 A1 * 11/2003 Johns ..... B29C 43/36 264/320
2004/0069788 A1 * 4/2004 Johns ..... B65D 1/36 220/575
2005/0159284 A1 7/2005 Smith et al.
2005/0192171 A1 * 9/2005 Grischenko ..... B31B 70/00 493/178
2006/0198972 A1 * 9/2006 Ueda ..... B65D 1/34 428/35.2
2007/0042887 A1 * 2/2007 Johns ..... B31B 43/00 493/143
2007/0252307 A1 11/2007 Borst
2008/0015098 A1 1/2008 Littlejohn et al.
2008/0124421 A1 * 5/2008 Johns ..... B29C 45/4005 425/422
2008/0242525 A9 * 10/2008 Johns ..... B31B 43/00 493/143
2009/0215599 A1 8/2009 Johns et al.
2009/0232926 A1 * 9/2009 Sofronie ..... B29C 43/36 425/394
2011/0195829 A1 * 8/2011 Treccani ..... B31F 1/0077 493/174
2013/0309346 A1 11/2013 Jones et al.
2015/0203223 A1 * 7/2015 Ehrmann ..... B65B 31/02 493/52
2016/0176145 A1 6/2016 Vassa et al.
2016/0176147 A1 6/2016 Vassa et al.

OTHER PUBLICATIONS

Written Opinion of International Application No. PCT/US2015/066747, mailed by the International Searching Authority dated Apr. 1, 2016.
International Search Report of International Application No. PCT/US2015/066759, mailed by the International Searching Authority dated Apr. 6, 2016.
Written Opinion of International Application No. PCT/US2015/066759, mailed by the International Searching Authority dated Apr. 6, 2016.
International Search Report of International Application No. PCT/US2015/066776, mailed by the International Searching Authority dated Apr. 1, 2016.
Written Opinion of International Application No. PCT/US2015/066776, mailed by the International Searching Authority dated Apr. 1, 2016.
Extended European Search Report Mailed in European Application No. 15874199.1 dated Jun. 26, 2018.
Extended European Search Report Mailed in European Application No. 15874201.5 dated Jun. 28, 2018.
Extended European Search Report Mailed in European Application No. 15874202.3 dated Jul. 5, 2018.

* cited by examiner

METHODS FOR PRODUCING PRESSWARE

BACKGROUND

Field

Embodiments generally relate to systems and methods for producing pressware. More particularly, such embodiments relate to methods for producing paper plates.

Description of the Related Art

Machinery for making pressware typically has a pressware forming tool that utilizes die pairs. The die pairs generally have an upper male portion or punch as well as a lower female portion or die. The upper male portion is generally a movable die and the lower female portion is generally a stationary die that receives the upper male portion during production. Once the pressware is formed, the exiting formed pressware and the incoming unformed paperboard are typically on the same plane. Speed is limited due to the fact that the formed pressware must be sufficiently out of the lower female die to allow the unformed paperboard to enter the lower female die. The inherent slow rate of removing formed pressware and advancing incoming unformed paperboard on the same plane is inefficient with time and creates negative effects typically associated with pre-cut blank handling processes, such as complicated indexing of the pre-cut blanks advancing into the lower female die.

There is a need, therefore, for improved systems and methods for producing pressware.

SUMMARY

Systems and methods for producing pressware, such as paper plates, are provided. In one or more embodiments, the system can include an upper moveable platen, a lower moveable platen, a stationary platen, a punch platen, and one or more forming die assemblies. The upper moveable platen and the punch platen can be disposed above the stationary platen and the lower moveable platen can be disposed below the stationary platen. The upper moveable platen, the punch platen, and the lower moveable platen can be configured to move toward and away from the stationary platen. Each forming die assembly can include a set of upper and lower forming dies. The upper and lower forming dies can be coupled to the upper and lower moveable platens, respectively, and configured to press substrates to form pressware products within passageways extending through the stationary platen.

In one or more embodiments, a method for producing pressware can include producing a pressware product between an upper forming die and a lower forming die contained within a forming die assembly, retracting at least a portion of the upper forming die from the pressware product, ejecting the pressware product from the lower forming die while feeding a web material between the upper forming die and the lower forming die, cutting a segment of the web material to produce a substrate, and pressing the substrate between the upper forming die and the lower forming die to produce another pressware product.

In other embodiments, a method for producing pressware can include pressing a substrate between an upper forming die and a lower forming die to produce a pressware product, moving at least a first portion of the upper forming die away from the lower forming die, and moving at least a first portion of the lower forming die away from the upper forming die. The method can also include ejecting the pressware product from the lower forming die while feeding a web material between the upper forming die and the lower forming die, cutting a segment of the web material to produce another substrate, and pressing the produced substrate between the upper forming die and the lower forming die to produce another pressware product.

In other embodiments, a method for producing pressware can include feeding a web material between an upper forming die and a lower forming die moving in reciprocating and opposite directions from each other. The method can also include cutting a segment of the web material to produce a substrate, and pressing the substrate between the upper forming die and the lower forming die to produce another pressware product. The method can also include ejecting the pressware product from the lower forming die while at a position below the plane of the web material feeding between the upper forming die and the lower forming die, wherein at least a portion of feeding the web material and at least a portion of ejecting the pressware product occur at the same time.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
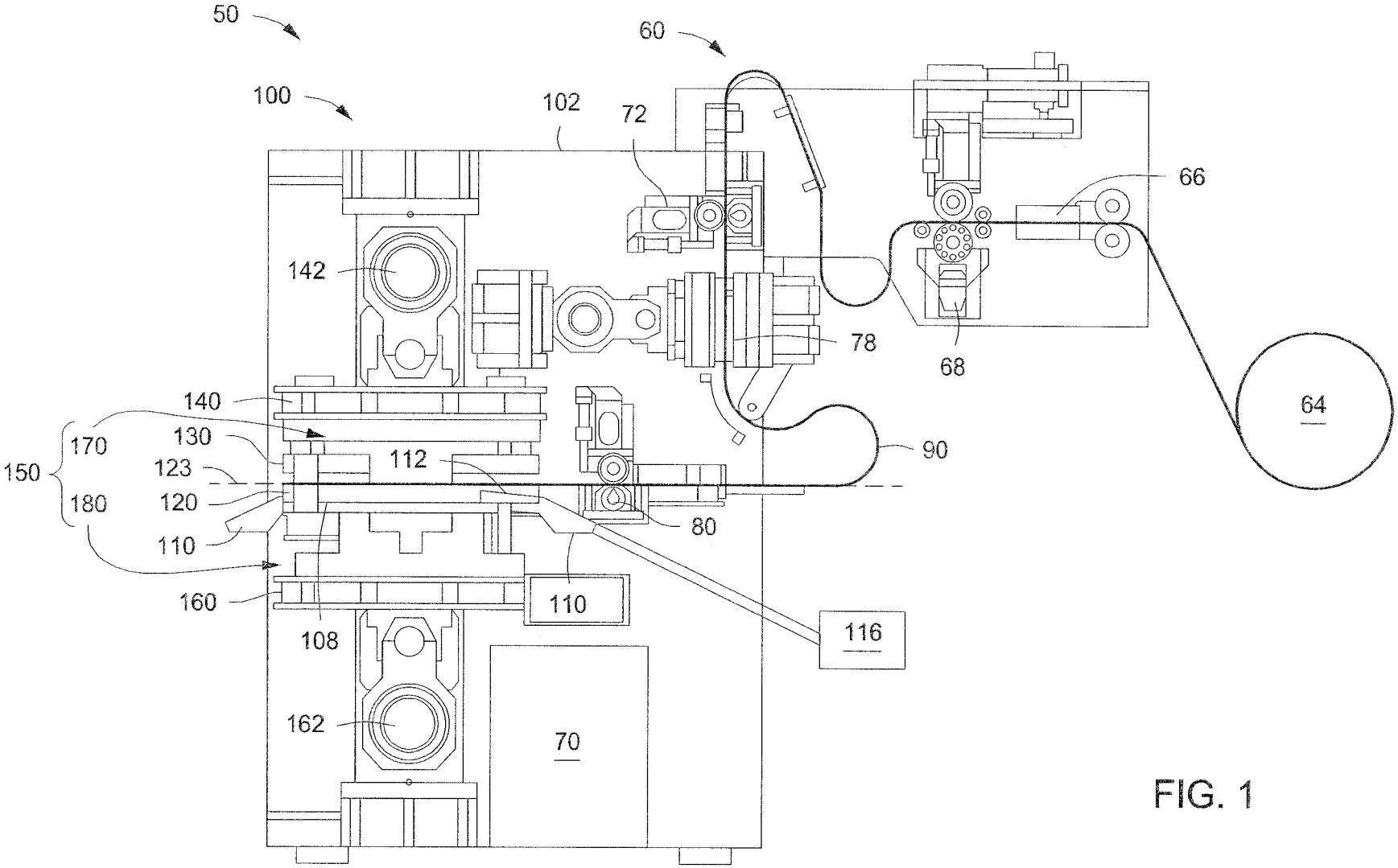
FIG. 1 depicts a perspective view of a pressware system that can include a press assembly and a paper feed system, according to one or more embodiments described.

FIG. 1 depicts a perspective view of a pressware system 50 for producing, forming, or otherwise making pressware products that can include a press assembly 100 and a paper feed system 60, according to one or more embodiments. FIGS. 2A-6B depict several perspective views of the press assembly 100. The press assembly 100 can be configured to produce pressware products and can include an upper moveable platen 140, a lower moveable platen 160, a stationary platen 120, a punch platen 130, and one or more forming die assemblies 150.

Each forming die assembly 150 can include an upper forming die 170 and a lower forming die 180. The upper forming die 170 can be coupled to the upper moveable platen 140 and the lower forming die 180 can be coupled to the lower moveable platen 160. The upper forming die 170 and the lower forming die 180 can be configured to adjoin or come together within a passageway 126 (shown in FIG. 2A), such as to contact and press a substrate for producing a pressware product.

FIGS. 1-6B depict the press assembly 100 having one forming die assembly 150 disposed between the upper moveable platen 140 and the lower moveable platen 160. However, the press assembly 100 can generally include a plurality of forming die assemblies 150, such as two, three, four, five, six, seven, eight, nine, ten, eleven, twelve, thirteen, fourteen, fifteen, sixteen, seventeen, eighteen, nineteen, or twenty forming die assemblies 150. In some configurations, the press assembly 100 can include two to about twenty forming die assemblies 150, two to about twelve forming die assemblies 150, two to about ten forming die assemblies 150, or two to about seven forming die assemblies 150 disposed between the upper moveable platen 140 and the lower moveable platen 160. In other examples, the press assembly 100 can include two to about six forming die assemblies 150. In other examples, the press assembly 100 can include two, three, four, or five forming die assemblies 150. Regardless of the number of forming die assemblies 150 in the press assembly 100, each forming die assembly 150 can include a set of the upper and lower forming dies 170, 180.

Figure 2A:
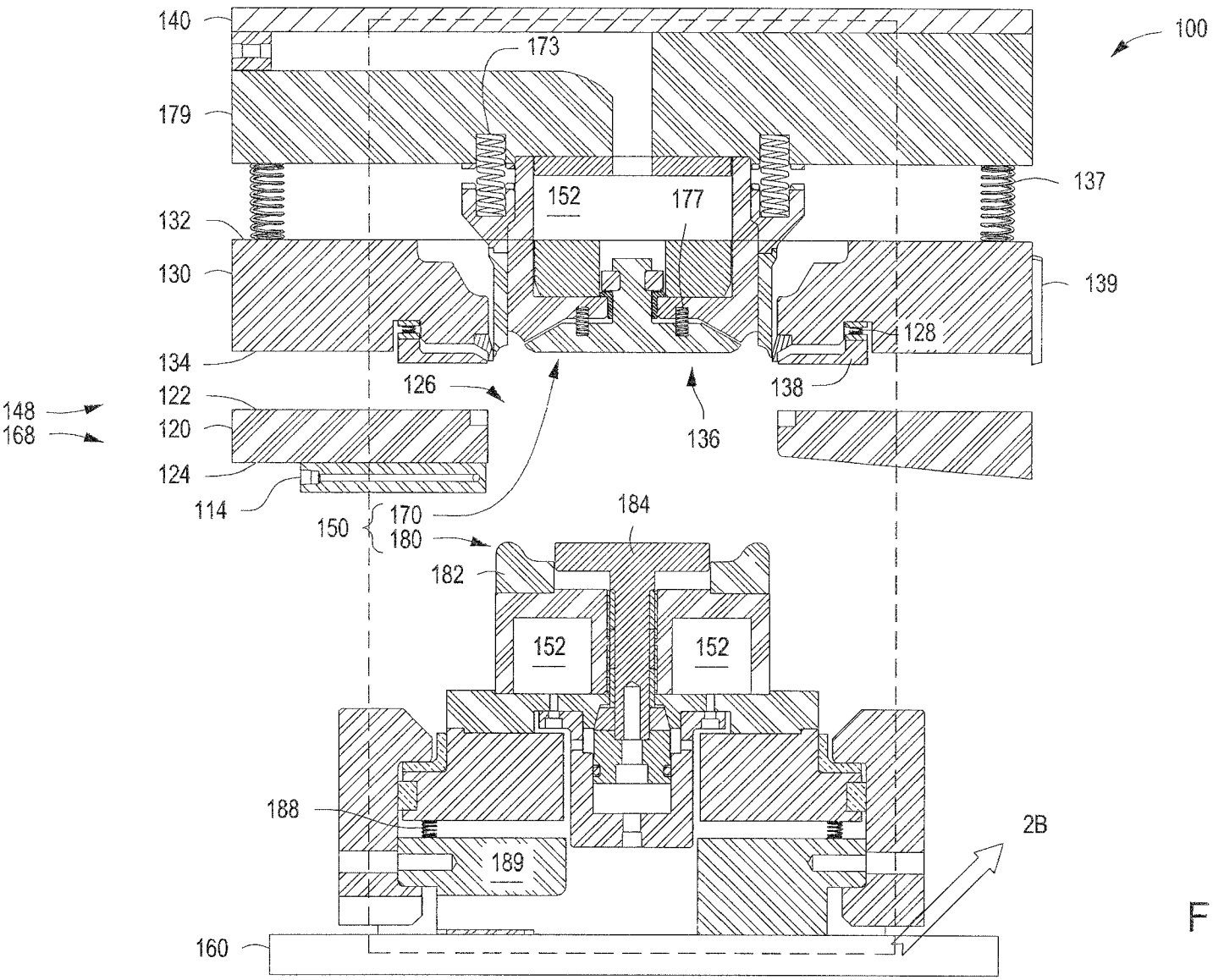
FIGS. 2A-6B depict exemplary views of the pressware assembly, depicted in FIG. 1, at different stages of being opened or closed, according to one or more embodiments described.

The stationary platen 120 can have an upper surface 122, a lower surface 124, and one or more passageways 126 extending through the stationary platen 120 between the upper surface 122 and the lower surface 124, as depicted in FIG. 2A. The stationary platen 120 can be directly or indirectly coupled to or otherwise attached to a support structure 102, such as a frame, a housing, a body, or other component of the press assembly 100, as depicted in FIG. 1. In some examples, one or more ledges 108 can be coupled to one or more support structures 102 and the stationary platen 120 can be disposed on, coupled to, attached to, or otherwise supported by the ledges 108. The stationary platen 120 can be positioned or otherwise disposed in a horizontal or substantially horizontal position within the press assembly 100 such that the upper surface 122 can face the upper moveable platen 140 and the lower surface 124 can face the lower moveable platen 160, as depicted in FIGS. 1 and 2A.

The stationary platen 120 can include the same number of passageways 126 as the number of forming die assemblies 150 included in the press assembly 100. FIGS. 1-6B depict the stationary platen 120 having one passageway 126 extending through the stationary platen 120. However, the stationary platen 120 can generally include a plurality of passageways 126, such as two, three, four, five, six, seven, eight, nine, ten, eleven, twelve, thirteen, fourteen, fifteen, sixteen, seventeen, eighteen, nineteen, or twenty passageways 126 extending therethrough and between the upper surface 122 and the lower surface 124. In some exemplary configurations, the stationary platen 120 can include two passageways 126 to about twenty passageways 126, two passageways 126 to about twelve passageways 126, or two passageways 126 to about seven passageways 126 extending through the stationary platen 120.

FIG. 1 further depicts that the upper moveable platen 140 can be disposed above the stationary platen 120. The upper moveable platen 140 can be configured to move toward and away from the upper surface 122 of the stationary platen 120. The lower moveable platen 160 can be disposed below the stationary platen 120. The lower moveable platen 160 can be configured to move toward and away from the lower surface 124 of the stationary platen 120. In one configuration, the upper moveable platen 140 and the lower moveable platen 160 can be independently configured to move linearly. As used herein, the term "linearly" means any straight or substantially straight line or path. In another configuration, the upper moveable platen 140 and the lower moveable platen 160 can be independently configured to move non-linearly. As used herein, the term "non-linearly" means any non-straight line or path.

Referring again to FIG. 1, the punch platen 130 can be disposed between the upper moveable platen 140 and the stationary platen 120. The punch platen 130 can have an upper surface 132, a lower surface 134, and one or more passageways 136 extending through the punch platen 130 between the upper surface 132 and the lower surface 134, as depicted in FIG. 2A. The punch platen 130 can be positioned or otherwise disposed within the press assembly 100 such that the upper surface 132 can face the upper moveable platen 140 and the lower surface 134 can face the stationary platen 120, as depicted in FIGS. 1 and 2A. For example, the punch platen 130 is shown as horizontal or substantially horizontal (e.g., a horizontal position) relative to the movements of the upper moveable platen 140 and the lower moveable platen 160.

The punch platen 130 can include the same number of passageways 136 as the number of forming die assemblies 150 contained in the press assembly 100. FIGS. 1-6B depict the punch platen 130 having one passageway 136 extending through the punch platen 130. However, the punch platen 130 can generally include a plurality of passageways 136, such as two, three, four, five, six, seven, eight, nine, ten, eleven, twelve, thirteen, fourteen, fifteen, sixteen, seventeen, eighteen, nineteen, or twenty passageways 136 extending therethrough and between the upper surface 132 and the lower surface 134. In some exemplary configurations, the punch platen 130 can include two passageways 136 to about twenty passageways 136, two passageways 136 to about twelve passageways 136, or two passageways 136 to about seven passageways 136 extending through the punch platen 130.

The punch platen 130 can be configured to move (e.g., vertically move) toward and away from the stationary platen 120. In some embodiments, the punch platen 130 can be coupled to the upper moveable platen 140 or the stationary platen 120 by one or more punch springs 137, and/or one or more other extendable members. Extendable members can include, but not limited to, one or more mechanical, hydraulic, and/or pneumatic extendable members. Exemplary extendable members can be or include one or more springs, cams, rams, actuators, pistons, shafts, rods, arms, guides, rack and pinion systems, or any combination thereof. The one or more punch springs 137 can be configured to control at least a portion of the movement by the punch platen 130. The portion of the movement of the punch platen 130 can be independent of the upper moveable platen 140.

Figure 2B:
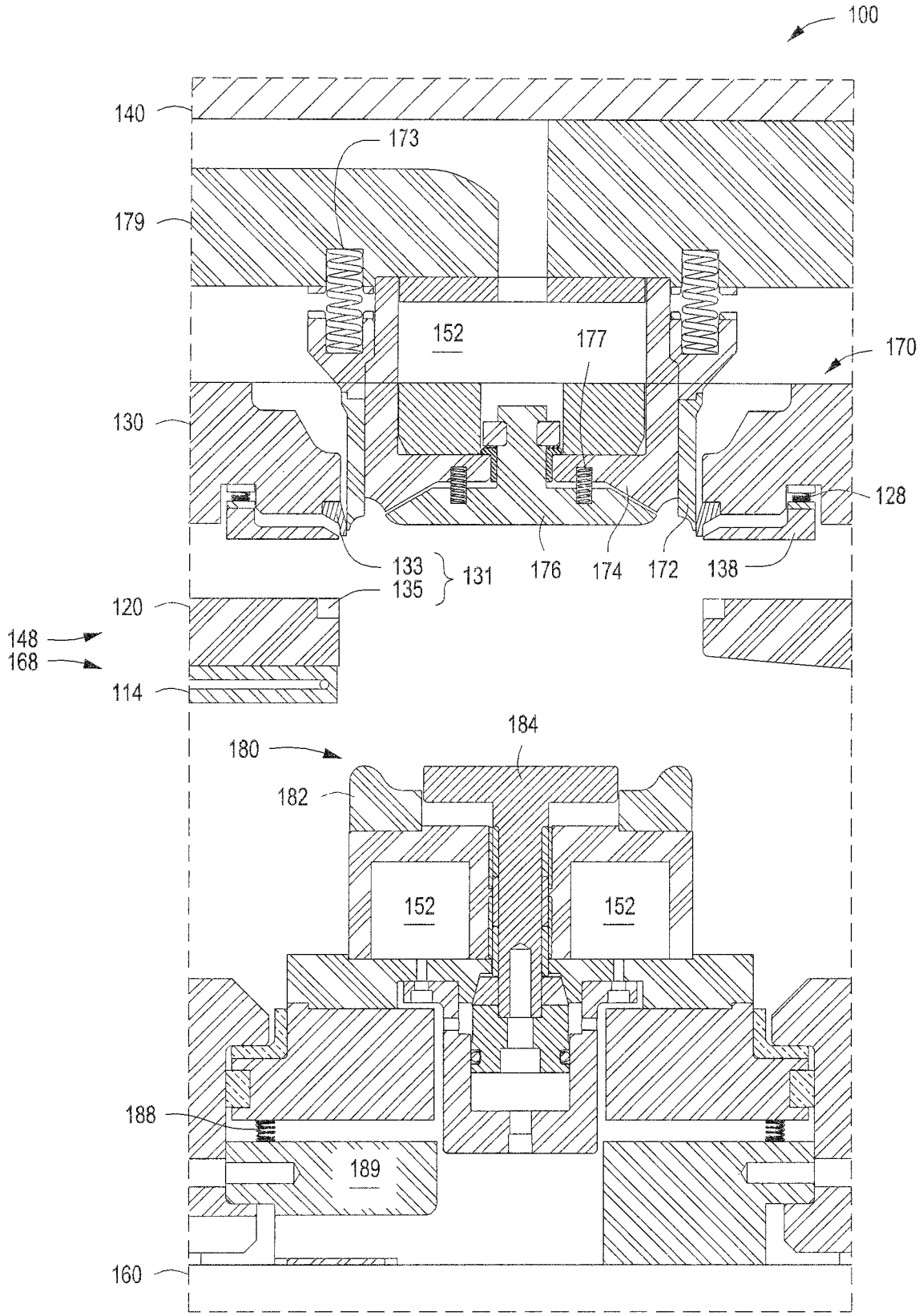

The press assembly 100 can also include a shearing die 131 that can include an upper shear 133 and a lower shear 135, as depicted in FIG. 2B. The upper shear 133 can be coupled to the punch platen 130 and can be partially or completely disposed around the passageway 136, such as at or on the lower surface 134. The lower shear 135 can be coupled to the stationary platen 120 and can be partially or completely disposed around the passageway 126, such as at or on the upper surface 122. The upper shear 133 can be configured to move to at least partially extend into the passageway 126 and to cut a blank or substrate from an incoming web or paper 90. Subsequently, the blank or substrate can be further processed, such as pressed between the upper forming die 170 and the lower forming die 180, to produce the pressware product.

The press assembly 100 can include a plurality of the shearing dies 131, and can generally include the same number of shearing dies 131, as the number of forming die assemblies 150 contained in the press assembly 100. The press assembly 100 can include one, two, three, four, five, six, seven, eight, nine, ten, eleven, twelve, thirteen, fourteen, fifteen, sixteen, seventeen, eighteen, nineteen, or twenty of the shearing dies 131. In some configurations, the press assembly 100 can include two to about twenty of the shearing dies 131, two to about twelve of the shearing dies 131, two to about ten of the shearing dies 131, or two to about seven of the shearing dies 131. In some examples, the press assembly 100 can include two to about six of the shearing dies 131. In other examples, the press assembly 100 can include two, three, four, or five of the shearing dies 131.

Referring again to FIG. 1, the paper feed system 60 can include one or more web or paper supplies or source 64 (e.g., rolls of web or paper), one or more decurling systems 66, one or more pull rolls 68, one or more paper feeds 72, 80, and one or more scoring units 78. Each of the decurling system 66, the pull roll 68, the paper feeds 72, 80, and the scoring unit 78 can be independently positioned or otherwise disposed in any position, including, but not limited to, horizontal positions, vertical positions, or any position therebetween. In one or more embodiments, the decurling system 66 can be disposed in a horizontal position and the scoring unit 78 can be disposed in a vertical position relative to the plane of the web or paper 90 passing therethrough, as depicted in FIG. 1. In other embodiments, not shown, the decurling system 66 can be disposed in a vertical position, and independently, the scoring unit 78 can be disposed in a horizontal position relative to the plane of the web or paper 90 passing therethrough. Alternatively, in other embodiments not shown, the decurling system 66 and the scoring unit 78 can both be disposed in vertical positions or horizontal positions relative to the plane of the web or paper 90. In some embodiments, the scoring unit 78 can be disposed upstream of the paper feed 80, such that the web or paper 90 can be processed by the scoring unit 78 prior to passing through the paper feed 80, as depicted in FIG. 1. In other embodiments, not shown, the scoring unit 78 can be disposed downstream of the paper feed 80, such that the web or paper 90 can be processed by the scoring unit 78 after passing through the paper feed 80.

The paper feed system 60 can be configured to treat, condition, and/or otherwise process fiber or paper containing materials and can feed or otherwise deliver a web of such fiber or paper containing material to the press assembly 100 for producing pressware products. In one embodiment, the paper feed system 60 can provide the web or paper 90 through the paper feed 80 and across the upper surface 122 of the stationary platen 120 along a web path or a web line 123, which can generally be in the plane of the incoming web or paper 90. The paper feed system 60 and the press assembly 100 can advance the web or paper 90 between the upper and lower forming dies 170, 180 of one or more forming die assemblies 150. The blanks or substrates 82 can be stamped, cut, or otherwise formed from the web or paper 90. The webbing scraps (not shown) can be formed from the remaining webbing or paper material from which the blanks or substrates 82 were cut. The webbing scraps (not shown) can be moved along the web line 123 and can be ejected out the opposite side of the press assembly 100 as the paper feed 80. A cutting tool 139, such as a blade, a scrap knife, or another type of blade or cutting instrument, can be disposed on the press assembly 100 and can be configured to sever or cut the webbing scrap 91 that exits from between the punch platen 130 and the stationary platen 120.

The formed substrates 82 can be processed to produce pressware products 92 which can be ejected or removed by different techniques from the press assembly 100. The pressware products 92 can be ejected or removed by movement of the lower knockout 184, by gaseous flow or burst from one or more nozzles 114, or a combination thereof. The pressware products 92 can be ejected or removed from the die assemblies 150 when the pressware products 92 are positioned below the web line 123. The pressware products 92 can be ejected or moved through one or more chute entrances 112 and to one or more chutes 110 via one or more nozzles 114. In one embodiment, the pressware products 92 can be ejected by a gaseous flow or one or more gas bursts directed by the nozzles 114 to move the pressware products 92 through the chute entrances 112 and to the chutes 110. Thereafter, the pressware products 92 can be moved from the chutes 110 to one or more conveying systems 116 to direct the pressware products 92 away from the chutes 110. Although FIG. 1 depicts only one of the conveying systems 116 coupled to one of the chutes 110, one or more other conveying systems 116 can be operably coupled to the press assembly 100, such as to additional chutes 110.

The nozzles 114 can be disposed below the lower surface 124 of the stationary platen 120 and adjacent to each chute entrance 112 and/or each chute 110. The nozzles 114 can be configured to blow pressed products from the lower knockout 184 to the chute 110 via the chute entrance 112. The chutes 110 can be disposed at least partially below the lower surface 124 of the stationary platen 120 and the chute entrances 112 and can be attached to or formed within the lower surface 124 of the stationary platen 120. The chutes 110 and the chute entrances 112 can be configured to receive pressed products produced in the forming die assembly 150. In some examples, the press assembly 100 can also include two or more sets of the nozzles 114 and the chutes 110.

In one or more embodiments, the press assembly 100 for producing pressware can include a first driving member or the upper driving member 142 and a second driving member or the lower driving member 162, as depicted in FIG. 1. The upper moveable platen 140 can be disposed above the stationary platen 120 and coupled to the upper driving member 142 and the lower moveable platen 160 can be disposed below the stationary platen 120 and coupled to the lower driving member 162. The upper driving member 142 can be configured to move (e.g., vertically move) the upper moveable platen 140 toward and away from the upper surface 122 of the stationary platen 120. Similarly, the lower driving member 162 can be configured to move (e.g., vertically move) the lower moveable platen 160 toward and away from the lower surface 124 of the stationary platen 120. The upper driving member 142 and the lower driving member 162 can be configured to provide movement (e.g., reciprocating movement) for the upper moveable platen 140 and the lower moveable platen 160, respectively, toward and away from the stationary platen 120. Each of the upper driving member 142 and the lower driving member 162 can be independent or include one or more rams, cams, actuators, shafts, arms, pistons, motors, or the like that can be configured to provide the movement toward and away from the stationary platen 120. In some examples, the upper driving member 142 and the lower driving member 162 can be independent or include one or more pneumatic or hydraulic rams, cams, actuators, or pistons. In other examples, the upper driving member 142 and the lower driving member 162 can be independent or include one or more shafts and/or motors, such as a concentric shaft coupled to a motor.

A system controller 70 can be operatively coupled to the press assembly 100 and the paper feed system 60 of the pressware system 50. The system controller 70 can include one or more microprocessors, one or more controllers, one or more switches, one or more software programs, and/or other equipment or devices that can activate and control one or more of components or systems of the pressware system 50, including, but not limited to, the paper feed system 60 and/or the press assembly 100. In one embodiment, as depicted in FIG. 1, the system controller 70 can be a portion of or attached to the press assembly 100. In another embodiment, not shown, the system controller 70 can be independent or free standing from the press assembly 100. The system controller 70 can be independently operatively coupled to any components of the paper feed system 60 for advancing and processing the web or paper 90. For example, the system controller 70 can activate and subsequently operate or otherwise control the web or paper supplies or source 64, the decurling systems 66, the pull rolls 68, the paper feeds 72, 80, the scoring units 78, or any other component of the paper feed system 60. The system controller 70 can also independently be operatively coupled to any components of the press assembly 100 for further processing the incoming web or paper 90 and producing the pressware products 92. For example, the system controller 70 can activate and subsequently operate or otherwise control the upper driving member 142, the lower driving member 162, the lower knockout 184, the nozzles 114, the conveying systems 116, or any other component of the press assembly 100.

FIGS. 2A and 2B depict perspective views of the press assembly 100. The upper forming die 170 can include a pressure ring 172, a forming punch 174, and an upper knockout 176. The pressure ring 172 can partially or completely encompass or encircle the forming punch 174 and the upper knockout 176. The pressure ring 172, the forming punch 174, and the upper knockout 176 can be configured to move with the upper moveable platen 140 toward and away from the lower forming die 180. Also, the pressure ring 172 and the upper knockout 176, independent of each other, can be configured to move separately of the forming punch 174 and/or the upper moveable platen 140. For example, the pressure ring 172 can be coupled to the upper moveable platen 140 by one or more pressure ring springs 173 and the upper knockout 176 can be coupled to the forming punch 174 by one or more upper knockout springs 177. Alternatively, not shown, the pressure ring 172 can be coupled to the upper moveable platen 140 by one or more extendable members (e.g., springs, pistons, actuators, cams, or rams) and the upper knockout 176 can be coupled to the forming punch 174 by one or more upper knockout springs 177 (e.g., springs, pistons, actuator, cams, or rams).

The lower forming die 180 can include a contour rim 182 and a lower knockout 184. The contour rim 182 can partially or completely encompass or encircle the lower knockout 184. The contour rim 182 and the lower knockout 184 can be configured to move with the lower moveable platen 160 toward and away from the upper forming die 170, and the lower knockout 184 can be configured to move separately of the contour rim 182. In some examples, the lower knockout 184 can be configured to be driven by a piston 186, such as a hydraulic or pneumatic piston, ram, cam, actuator, or shaft. In another embodiment, the press assembly 100 can include one or more lower forming springs 188 disposed within the lower forming die 180 or can be disposed between and coupled to the lower moveable platen 160 and the lower forming die 180. The lower forming springs 188 can be configured to produce a forming pressure across the forming die assembly 150. In some embodiments, the forming die assembly 150 can include one or more temperature control devices 152 within or coupled to the upper forming die 170 and/or the lower forming die 180. The temperature control devices 152 can be independently configured to maintain, regulate, and/or adjust (e.g., increase or decrease) the temperature of the upper forming die 170, the lower forming die 180, and/or portions or segments thereof. The system controller 70 can be operatively coupled to the temperature control devices 152 for independently controlling the temperatures of the upper forming die 170 and the lower forming die 180.

The press assembly 100 can also include a stripper plate 138 disposed from or below the lower surface 134 of the punch platen 130, depicted in FIGS. 2A and 2B. The stripper plate 138 can be coupled to the punch platen 139 by one or more stripper plate springs 128 disposed therebetween. The stripper plate 138 can be configured to move (e.g., vertically move) toward and away the upper surface 122 of the stationary platen 120 via the stripper plate springs 128. In one configuration, the stripper plate springs 128 can be disposed between and coupled to the punch platen 130 and the stripper plate 138. As shown in FIGS. 2A and 2B, the stripper plate 138 is disposed below the lower surface 134 of the punch platen 130 with the stripper plate springs 128 in a decompressed state. In use, the stripper plate 138 can contact and tighten the incoming web or paper 90, such as to prepare the incoming web or paper 90 to be cut into substrates by the shearing die 131. As the stripper plate 138 contacts the incoming web or paper 90, compression in the stripper plate springs 128 can increase until the stripper plate springs 128 become fully compressed.

Any of the springs described herein, including, but not limited to, the stripper plate springs 128, the punch springs 137, the pressure ring springs 173, the upper knockout springs 177, and the lower forming springs 188, can be at a fully compressed state at different periods of the process cycle in the press assembly 100 or another press assembly. As used herein, in reference to any of the springs described herein, the term "fully compressed" means that the spring is compressed to a maximum compressibility of the spring relative to being used within a press assembly, but the spring itself can still have remaining compressibility. Similarly, as used herein, in reference to any of the springs described herein, the term "decompressed" means that the spring is decompressed to a maximum decompressibility of the spring relative to being used within a press assembly, but the spring itself can still have remaining decompressibility.

FIGS. 2A-6B depict exemplary views of the press assembly 100 at different opened or closed positions, according to one or more embodiments. The opened or closed positions of the press assembly 100 can be correlated to different stages of a process cycle. FIGS. 2A and 2B depict the press assembly 100 positioned in an initial opened position, such that the upper moveable platen 140 and the lower moveable platen 160 can be fully or substantially separated from each other. The upper moveable platen 140 and the lower moveable platen 160 can be independently positioned at any distance from each other when the press assembly 100 is in the initial opened position. For example, when in the initial opened position, each of the upper moveable platen 140 and the lower moveable platen 160 can be independently about 0.5 inches to about 12 inches, about 0.5 inches to about 10 inches, about 0.5 inches to about 8 inches, about 0.5 inches to about 6 inches, about 0.5 inches to about 4 inches, about 0.5 inches to about 2 inches, about 0.5 inches to about 1 inch, about 1 inch to about 12 inches, about 1 inch to about 10 inches, about 1 inch to about 8 inches, about 1 inch to about 6 inches, about 1 inch to about 4 inches, about 1 inch to about 2 inches, about 2 inches to about 12 inches, about 2 inches to about 8 inches, or about 2 inches to about 6 inches from a fully closed position. The upper knockout springs 177, the pressure ring springs 173, the stripper plate springs 128, the punch springs 137, and the lower forming springs 188 are depicted in FIG. 2A in decompressed states.

In some examples, each of the upper moveable platen 140 and the lower moveable platen 160 can have a stroke of about 0.5 inches, about 0.75 inches, about 1 inch, about 1.25 inches, about 1.5 inches, about 1.75 inches, about 2 inches, about 2.25 inches, about 2.5 inches, about 2.75 inches, about 3 inches, about 3.25 inches, about 3.5 inches, about 3.75 inches, about 4 inches, about 4.25 inches, about 4.5 inches, about 4.75 inches, about 5 inches, about 5.25 inches, about 5.5 inches, about 5.75 inches, about 6 inches, about 6.25 inches, about 6.5 inches, about 6.75 inches, about 7 inches, about 7.25 inches, about 7.5 inches, about 7.75 inches, about 8 inches, about 8.25 inches, about 8.5 inches, about 8.75 inches, about 9 inches, about 9.5 inches, about 10 inches, about 10.5 inches, about 11 inches, about 11.5 inches, or about 12 inches. In other examples, each of the upper moveable platen 140 and the lower moveable platen 160 can have a stroke of about 0.5 inches to about 6 inches, about 1 inch to about 8 inches, about 1 inch to about 6 inches, about 1 inch to about 5 inches, about 2 inches to about 4 inches, or about 3 inches. In some examples, the upper moveable platen 140 and the lower moveable platen 160 can have the same stroke or different strokes relative to each other.

Figure 3:
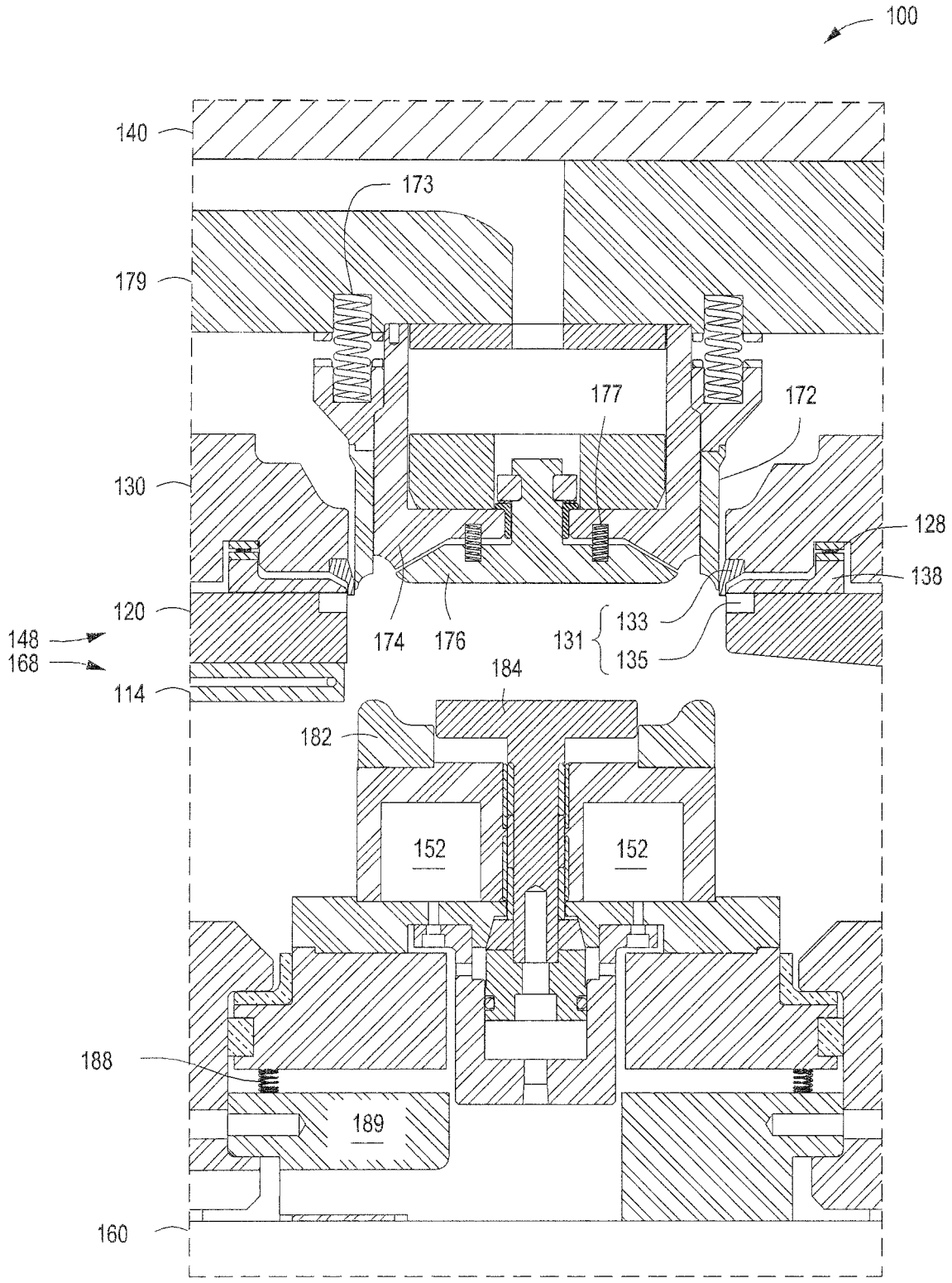

FIG. 3 depicts the press assembly 100 positioned in a partially closed position, such that the upper moveable platen 140 and the lower moveable platen 160 are vertically closer to each other and closer to the fully closed position than depicted in FIGS. 2A and 2B. The punch platen 130 is depicted to have moved about the same distance as the upper moveable platen 140. FIG. 3 also depicts that the stripper plate springs 128, the upper knockout springs 177, the pressure ring springs 173, and the lower forming springs 188 are in the same decompressed states.

Figure 4:
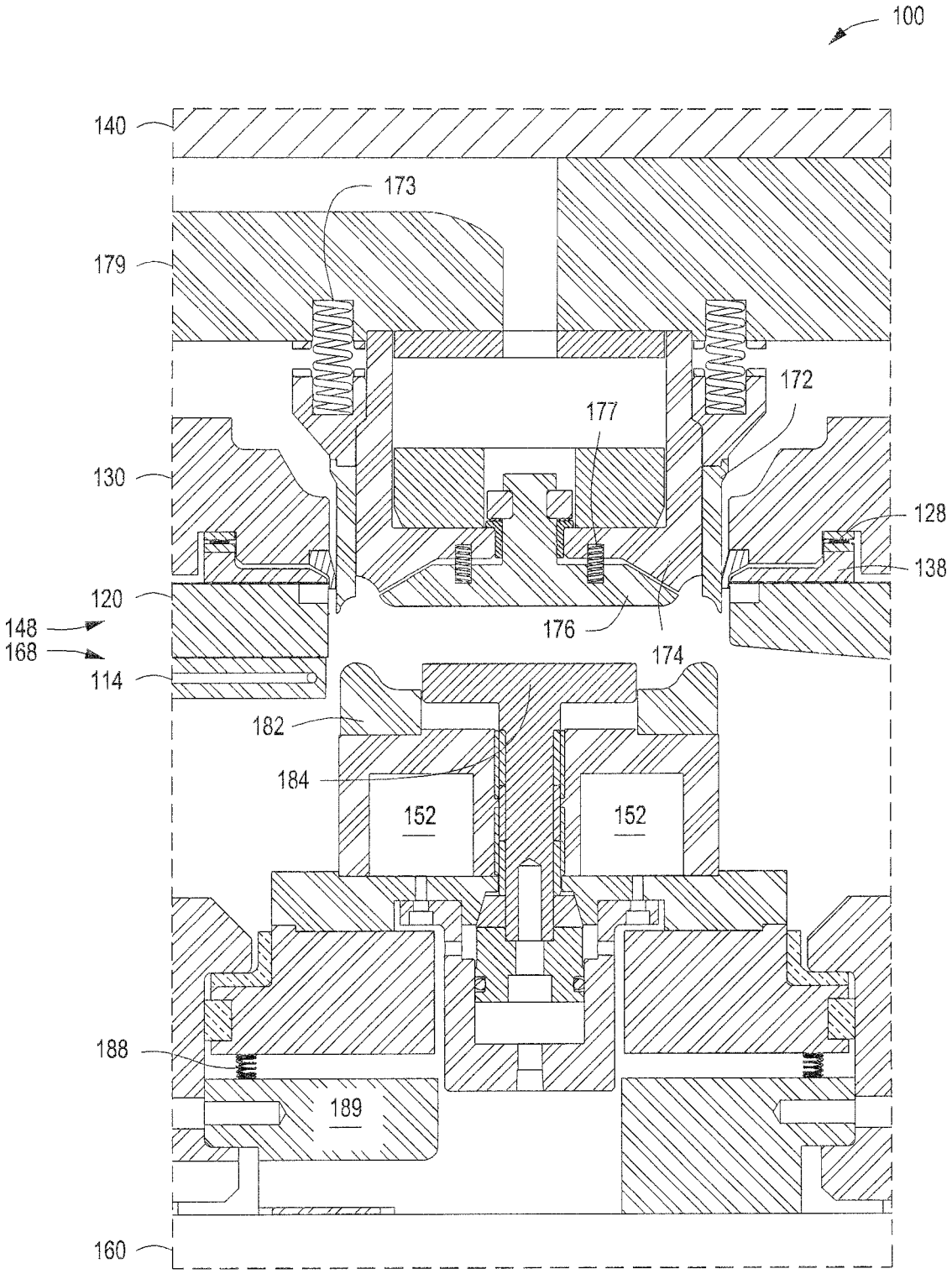

FIG. 4 depicts the press assembly 100 positioned in a further closed position, such that the upper moveable platen 140 and the lower moveable platen 160 are vertically closer to each other and closer to the fully closed position than depicted in FIG. 3. FIG. 4 also depicts that the stripper plate springs 128, the upper knockout springs 177, and the pressure ring springs 173, and the lower forming springs 188 are in the same decompressed states.

Figure 5:
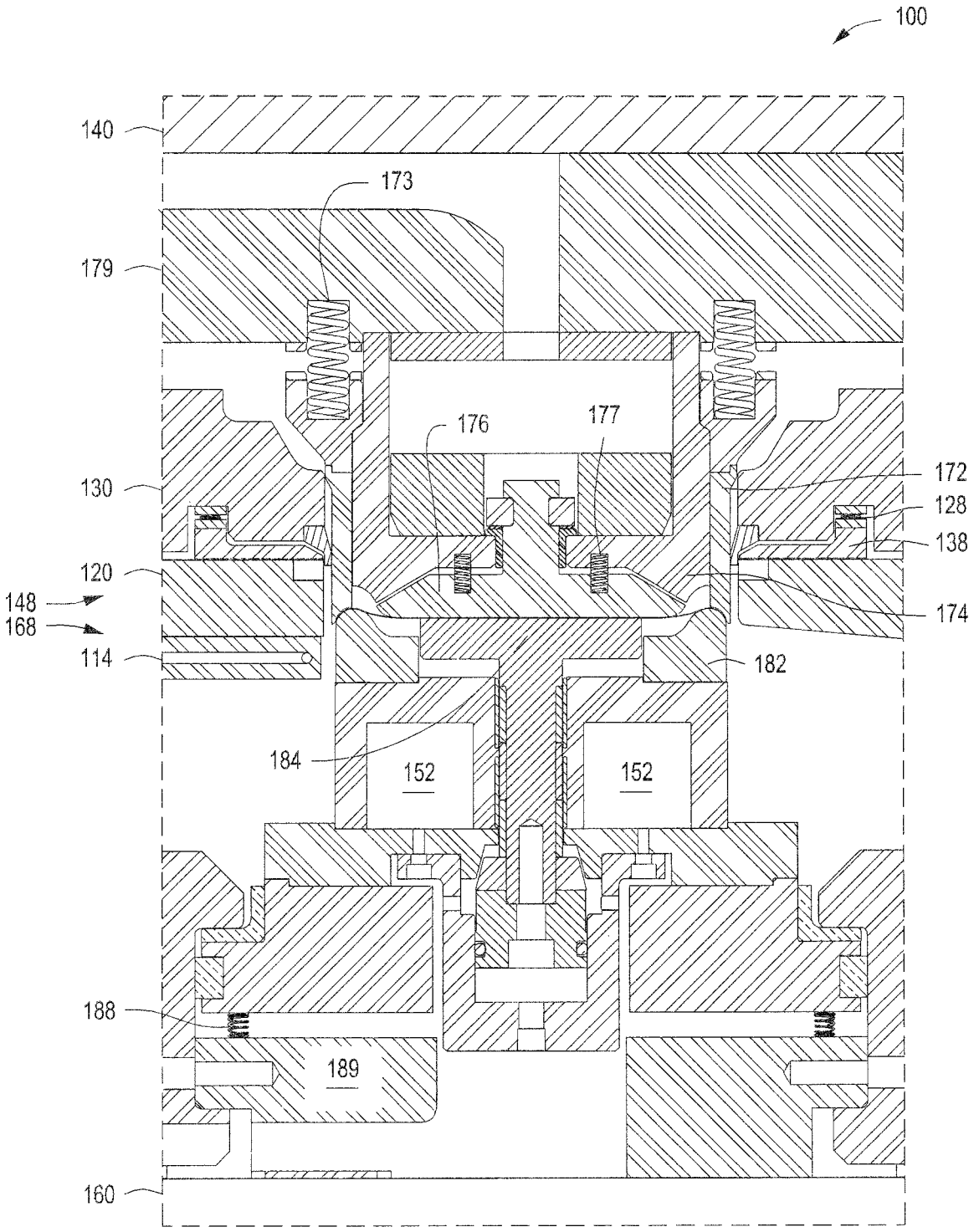

FIG. 5 depicts the press assembly 100 positioned in a further closed position, such that the upper moveable platen 140 and the lower moveable platen 160 are vertically closer to each other and closer to the fully closed position than depicted in FIG. 4. Also, the stripper plate 138 is depicted contacting the stationary platen 120 and stripper plate springs 128 are depicted as fully compressed in FIG. 5. In one or more configurations, the stripper plate springs 128 can be fully compressed before the lower forming springs 188 start to compress. FIG. 5 also depicts that the stripper plate springs 128 are compressed, and the upper knockout springs 177, the pressure ring springs 173, and the lower forming springs 188 are in the same decompressed states.

Figure 6A:
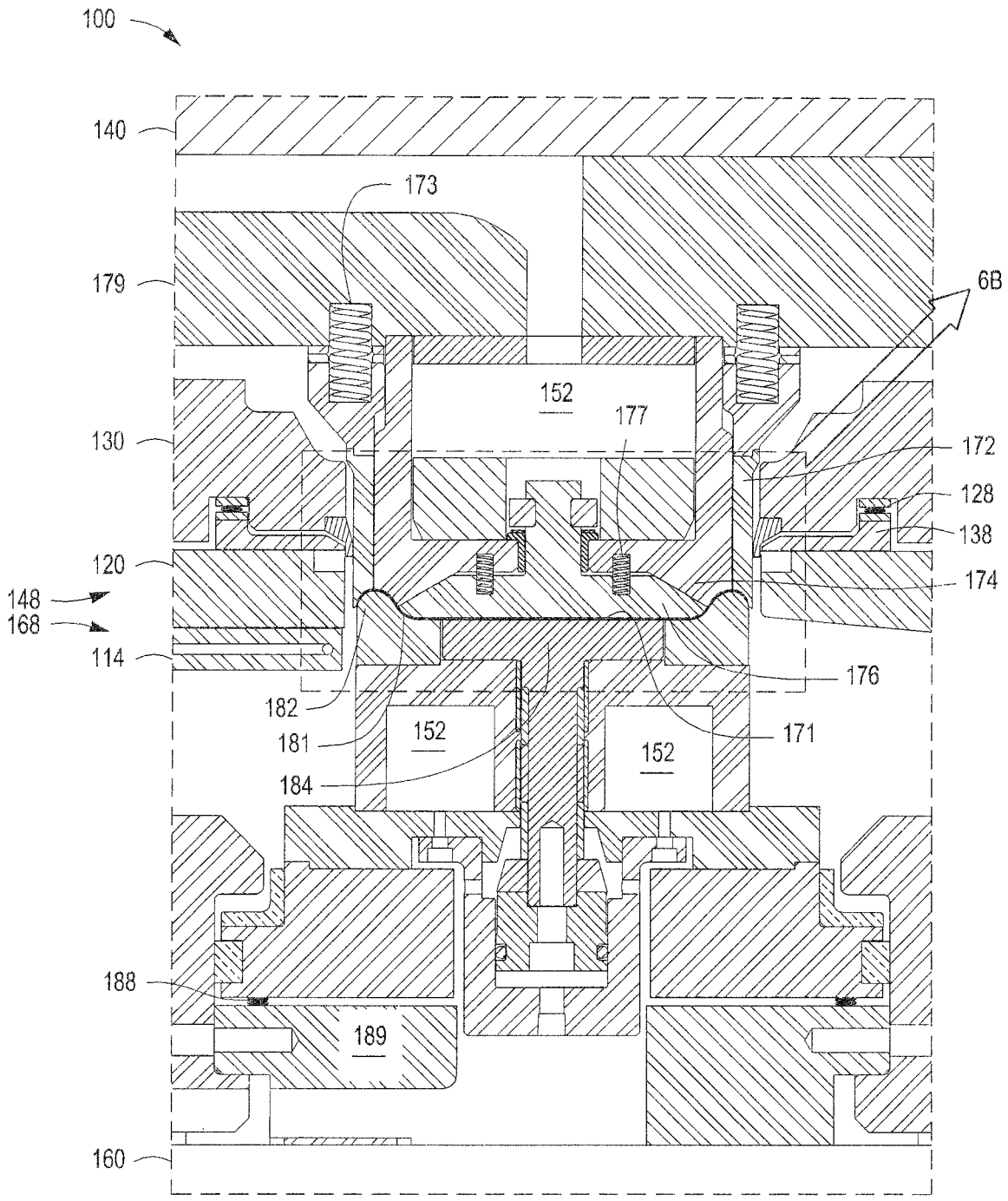
Figure 6B:
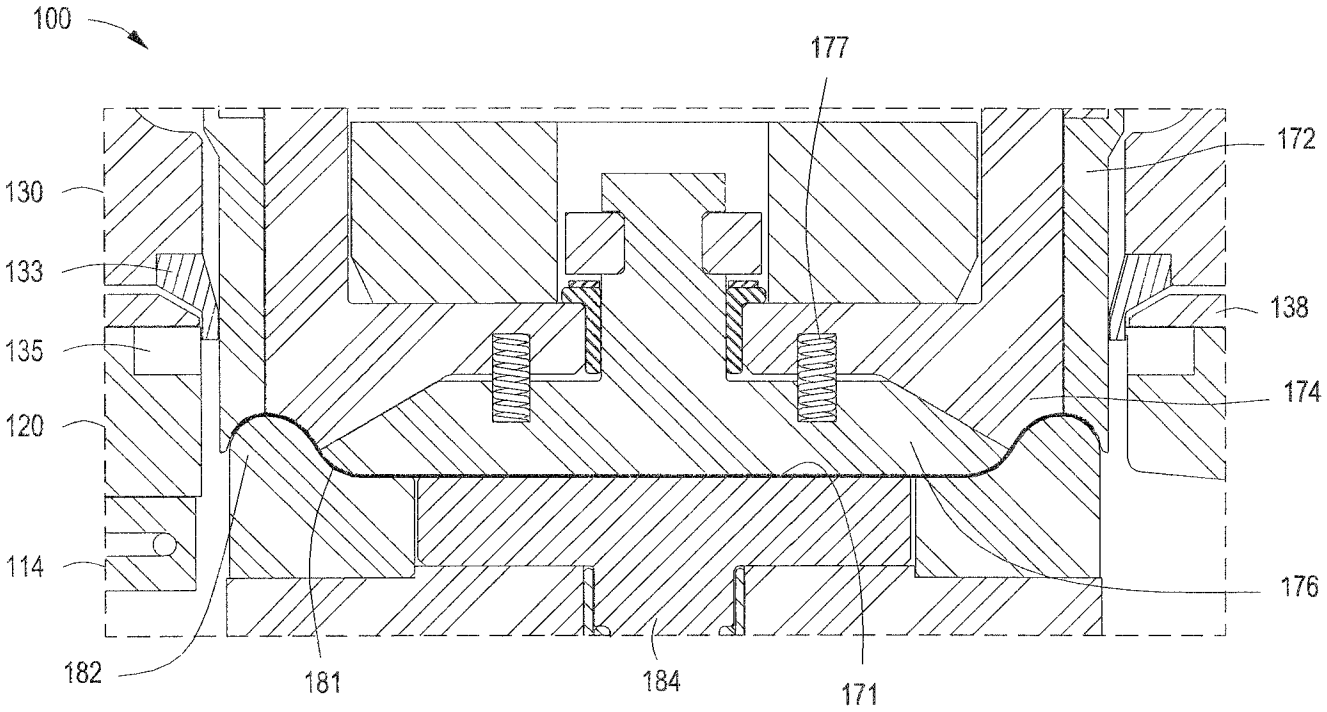

FIGS. 6A and 6B depict the press assembly 100 positioned in the fully closed position. FIGS. 6A and 6B also depict that upper knockout springs 177, the pressure ring springs 173, the stripper plate springs 128, and the lower forming springs 188 are in fully compressed states. FIG. 6B depicts the upper forming die 170 and the lower forming die 180 pressed and adjoined together forming the upper profile 171 and the lower profile 181. More specifically, the combination of the pressure ring 172, the forming punch 174, and the upper knockout 176 can form the upper profile 171 and the combination of the contour rim 182 and the lower knockout 184 can form the lower profile 181. In one or more embodiments, the upper forming die 170 can include a male profile or a punch profile for producing the upper profile 171 of the pressware product 92. Similarly, the lower forming die 180 can include a female profile or a forming profile for producing the lower profile 181 of the pressware product 92. The forming die assembly 150 can include a combined profile of the upper and lower profiles 171, 181 so to form a plate, a bowl, a tray, or other pressware products or paper products.

In some embodiments, the upper moveable platen 140 and the lower moveable platen 160 can be configured to cycle in relatively slow rates, such as at a low of about 5, about 10, or about 20 strokes per minute to a high of about 25, about 35, about 45, or about 50 strokes per minute. In other embodiments, faster rates may be more economical than slower rates. Therefore, the upper moveable platen 140 and the lower moveable platen 160 can be configured to cycle in relatively fast rates, such as at a low of greater than 50, about 70, or about 90 strokes per minute to a high of about 120, about 130, about 140, or about 150 strokes per minute. For example, the upper moveable platen 140 and the lower moveable platen 160 can be configured to cycle at a pressings rate of about 80 strokes per minute to about 130 strokes per minute, about 90 strokes per minute to about 120 strokes per minute, about 90 strokes per minute to about 110 strokes per minute, about 95 strokes per minute to about 115 strokes per minute, or about 100 strokes per minute to about 120 strokes per minute. In other embodiments, the upper moveable platen 140 and the lower moveable platen 160 can be configured to cycle at a rate of greater than 50, about 52, about 54, about 56, about 58, about 60, about 62, about 64, about 66, about 68, about 70, about 72, about 74, about 76, about 78, about 80, about 82, about 84, about 86, about 88, about 90, about 92, about 94, about 96, about 98, about 100, about 102, about 104, about 106, about 108, about 110, about 112, about 114, about 116, about 118, about 120, about 122, about 124, about 126, about 128, about 130, about 132, about 134, about 136, about 138, about 140, about 142, about 144, about 146, about 148, or about 150 strokes per minute. In some embodiments, the upper moveable platen 140 and the lower moveable platen 160 can be configured to cycle at a rate of about 50 strokes per minute to about 140 strokes per minute, about 60 strokes per minute to about 130 strokes per minute, about 70 strokes per minute to about 130 strokes per minute, about 70 strokes per minute to about 120 strokes per minute, or about 80 strokes per minute to about 120 strokes per minute.

The rate of the process cycle may be a function of the stroke rate and/or the dwell time of the upper moveable platen 140 and the lower moveable platen 160. Each forming die assembly 150 disposed on and between the upper moveable platen 140 and the lower moveable platen 160 can be configured to produce a pressware product 92 per process cycle. Therefore, each forming die assembly 150 can be configured to produce about 80, about 82, about 84, about 86, about 88, about 90, about 92, about 94, about 96, about 98, about 100, about 102, about 104, about 106, about 108, about 110, about 112, about 114, about 116, about 118, about 120, about 122, about 124, about 126, about 128, or about 130 pressware products per minute. For example, each forming die assembly 150 can be configured to produce about 80 pressware products per minute to about 120 pressware products per minute, about 80 pressware products per minute to about 110 pressware products per minute, about 90 pressware products per minute to about 120 pressware products per minute, about 90 pressware products per minute to about 110 pressware products per minute, or about 90 pressware products per minute to about 100 pressware products per minute.

In some examples, the press assembly 100 can include one forming die assembly 150 and can be configured to produce about 80 pressware products per minute to about 120 pressware products per minute. In other examples, the press assembly 100 can include two forming die assemblies 150 and can be configured to produce about 160 pressware products per minute to about 240 pressware products per minute. In other examples, the press assembly 100 can include three forming die assemblies 150 and can be configured to produce about 240 pressware products per minute to about 360 pressware products per minute. In other examples, the press assembly 100 can include four forming die assemblies 150 and can be configured to produce about 320 pressware products per minute to about 480 pressware products per minute. In other examples, the press assembly 100 can include five forming die assemblies 150 and can be configured to produce about 400 pressware products per minute to about 600 pressware products per minute. In other examples, the press assembly 100 can include six forming die assemblies 150 and can be configured to produce about 480 pressware products per minute to about 720 pressware products per minute. In other examples, the press assembly 100 can include seven forming die assemblies 150 and can be configured to produce about 560 pressware products per minute to about 840 pressware products per minute. In other examples, the press assembly 100 can include eight forming die assemblies 150 and can be configured to produce about 640 pressware products per minute to about 960 pressware products per minute. In other examples, the press assembly 100 can include nine forming die assemblies 150 and can be configured to produce about 720 pressware products per minute to about 1,080 pressware products per minute. In other examples, the press assembly 100 can include ten forming die assemblies 150 and can be configured to produce about 800 pressware products per minute to about 1,200 pressware products per minute. In other examples, the press assembly 100 can include twelve forming die assemblies 150 and can be configured to produce about 960 pressware products per minute to about 1,440 pressware products per minute. In other examples, the press assembly 100 can include fifteen forming die assemblies 150 and can be configured to produce about 1,200 pressware products per minute to about 1,800 pressware products per minute. In other examples, the press assembly 100 can include twenty forming die assemblies 150 and can be configured to produce about 1,600 pressware products per minute to about 2,400 pressware products per minute.

In some embodiments, the press assembly 100 can include one forming die assembly 150 and can be configured to produce about 80 pressware products per minute to about 100 pressware products per minute or about 85 pressware products per minute to about 95 pressware products per minute, where the pressware products can be round plates that have a diameter of about 8 inches to about 10 inches or about 8.5 inches to about 9.5 inches. In other embodiments, the press assembly 100 can include one forming die assembly 150 and can be configured to produce about 90 pressware products per minute to about 120 pressware products per minute or about 95 pressware products per minute to about 110 pressware products per minute, where the pressware products can be round plates that have a diameter of about 5 inches to about 9 inches or about 6 inches to about 8 inches. In other embodiments, the press assembly 100 can include two or more forming die assemblies 150 and can produce or form the respective amount of pressware products per minute as number of the forming die assemblies 150, where the pressware product can be round plates with a diameter of about 4 inches to about 12 inches, about 6 inches to about 10 inches, about 8 inches to about 10 inches, about 8.5 inches to about 9.5 inches, about 5 inches to about 9 inches, or about 6 inches to about 8 inches.

In one or more embodiments, as depicted in FIGS. 2A and 2B, the press assembly 100 can include the stationary platen 120, the punch platen 130, the upper moveable platen 140, the lower moveable platen 160, an upper tool assembly 148, and a lower tool assembly 168. The stationary platen 120 can be coupled to a support structure or housing 102 and can include the upper surface 122, the lower surface 124, and the passageway 126 extending through the stationary platen 120 between the upper and lower surfaces 122, 124. The upper moveable platen 140 can be disposed above the stationary platen 120 and can be configured to move toward and away from the upper surface 122 of the stationary platen 120. The lower moveable platen 160 can be disposed below the stationary platen 120 and can be configured to move toward and away from the lower surface 124 of the stationary platen 120. The punch platen 130 can be disposed between the upper moveable platen 140 and the stationary platen 120 and can be configured to move toward and away from the stationary platen 120. The punch platen 130 can include the upper surface 132, the lower surface 134, and the passageway 136 extending through the punch platen 130 between the upper and lower surfaces 132, 134.

The upper tool assembly 148 can include the upper forming die 170, the upper shear 133, and the lower shear 135. The upper forming die 170 can be coupled to the upper moveable platen 140 via an upper shoe or an upper forming base 179 of the upper forming die 170. The upper forming base 179 can be coupled to the upper moveable platen 140 by one or more fasteners including bolts, screws, and/or a quick release assembly. The upper shear 133 can be coupled to the punch platen 130 and can be disposed at least partially about the passageway 136 extending through the punch platen 130. The lower shear 135 can be coupled to the stationary platen 120 and can be disposed at least partially about the passageway 126 extending through the stationary platen 120. The upper forming die 170 can be configured to move to at least partially extend into the passageway 136 extending through the punch platen 130. The upper shear 133 can be configured to move to at least partially extend into the passageway 126 extending through the stationary platen 120.

The lower tool assembly 168 can include the lower forming die 180 which can be coupled to the lower moveable platen 160. The lower forming die 180 can be coupled to the lower moveable platen 160 via a lower shoe or forming base 189 of the lower forming die 180. The lower forming base 189 can be coupled to the lower moveable platen 160 by one or more fasteners including bolts, screws, and/or a quick release assembly. The upper forming die 170 and the lower forming die 180 can be configured to meet, to press together, or otherwise come together within the passageway 126 extending through the stationary platen 120.

Figure 7:
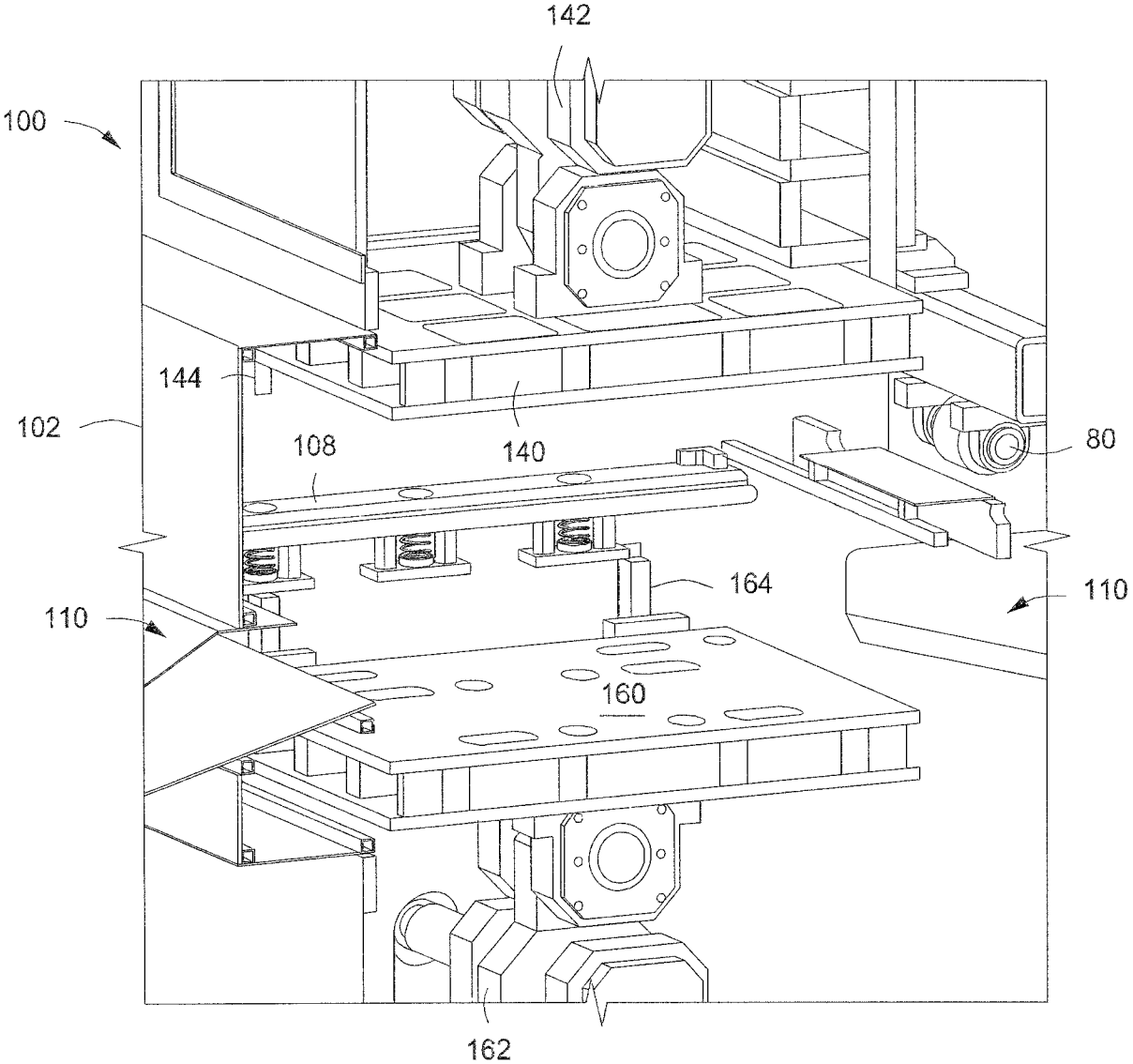
FIGS. 7-12 depict perspective views of the pressware assembly, depicted in FIG. 1, according to one or more embodiments described.
Figure 8:
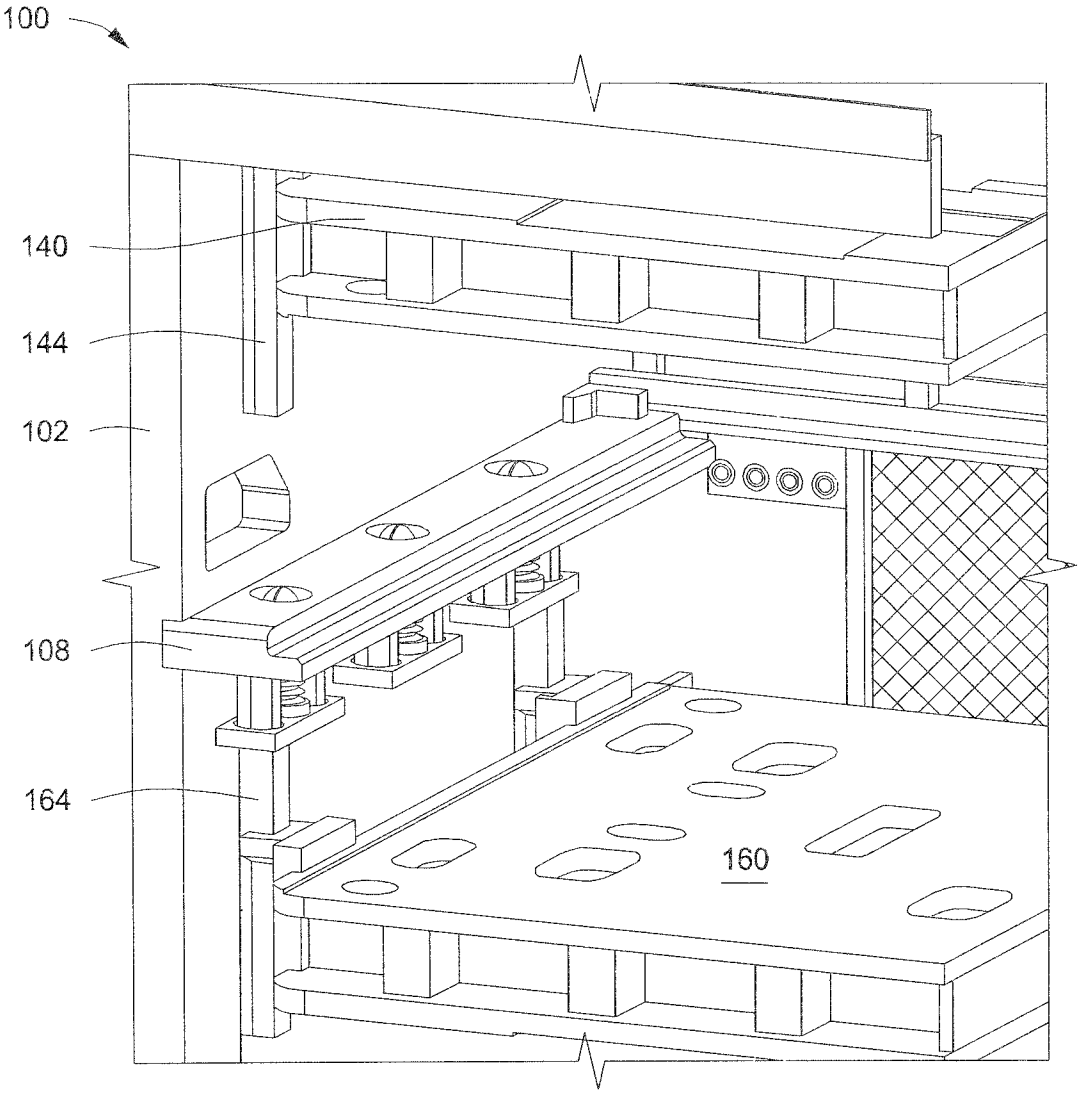

FIGS. 7 and 8 depict perspective views of the press assembly 100. One or more ledges 108 can be coupled to the support structure 102 and disposed between the upper moveable platen 140 and the lower moveable platen 160. The ledges 108 can be configured to support the stationary platen 120, shown in FIG. 1, but not shown in FIGS. 7 and 8. The stationary platen 120 can be disposed on, coupled to, attached to, or otherwise supported by one, two, or more ledges 108. For example, the stationary platen 120 can be coupled or attached to one or more ledges 108 by fasteners or welding. In other examples, not shown, the stationary platen 120, in part or by whole, can be directly coupled to or otherwise attached to the support structure 102 of the press assembly 100, such as by fasteners or welding.

The upper moveable platen 140 can be coupled to the driving member 142 and the lower moveable platen 160 can be coupled to the driving member 162 for driving and moving the upper moveable platen 140 and the lower moveable platen 160 toward and away from the ledges 108 (depicted in FIGS. 7 and 8) or the stationary platen 120 (depicted in FIG. 1). Also, the upper moveable platen 140 and the lower moveable platen 160 can be configured to independently move toward and away from the ledges 108 along one or more guides 144, 164, respectively, coupled to or formed in the support structure 102. The guides 144, 164 can be or include one or more rods, rails, tracks, or grooves. The upper moveable platen 140 can be coupled to one or more driving members 142 and one or more guides 144 to provide movement toward and away from the ledges 108. Similarly, the lower moveable platen 160 can be coupled to the driving member 162 and one or more guides 164 to provide movement toward and away from the ledges 108. In one or more embodiments, the upper moveable platen 140 and the lower moveable platen 160 can be configured to move toward and away from (e.g., reciprocating movement) the ledges 108 (depicted in FIGS. 7 and 8) or the stationary platen 120 (depicted in FIG. 1) via the driving members 142, 162 and the guides 144, 164, respectively.

Figure 9:
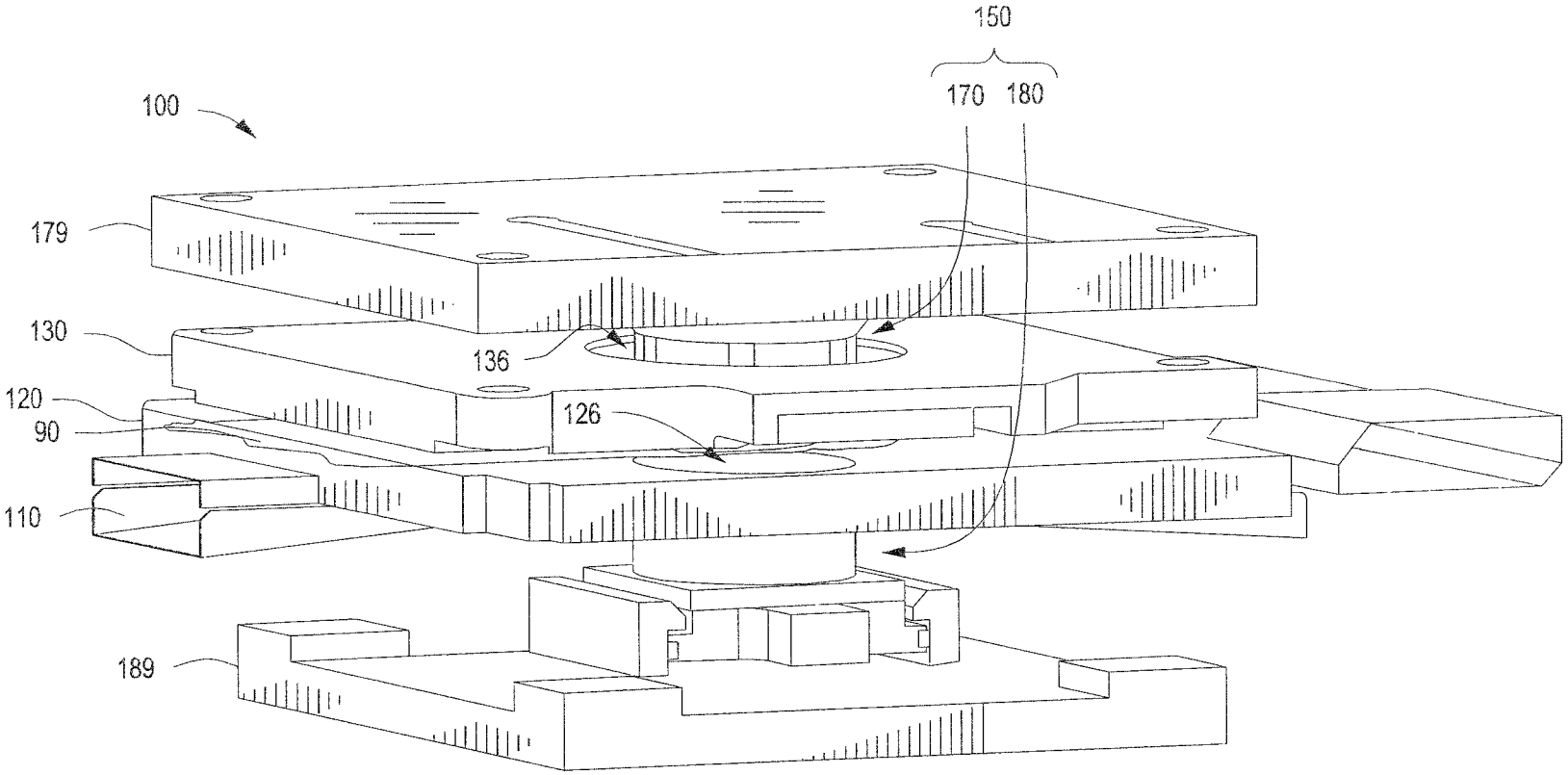
Figure 10:
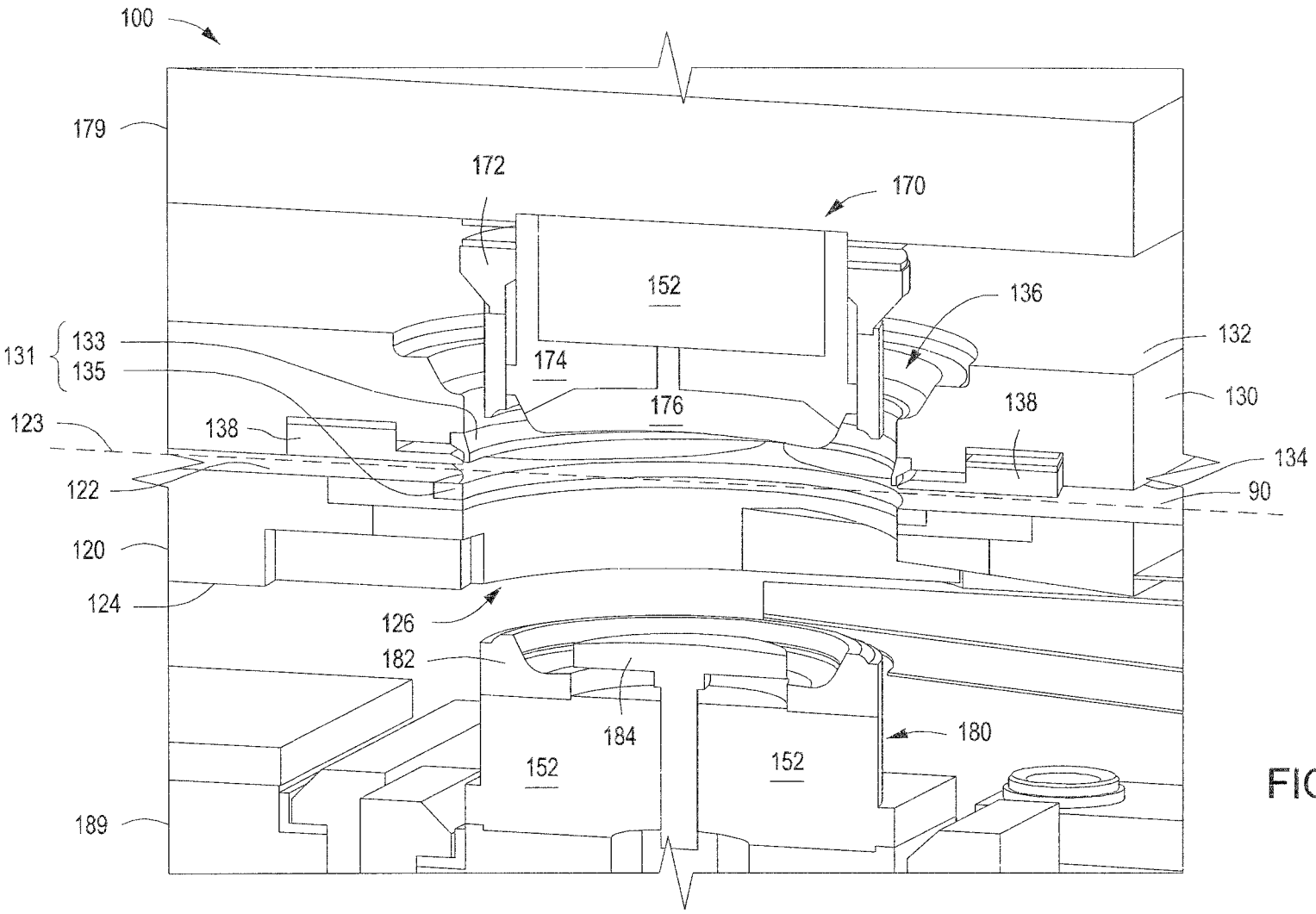

FIGS. 9 and 10 depict the stationary platen 120 having the passageway 126 extending therethrough between the upper surface 122 and the lower surface 124 and the punch platen 130 having the passageway 136 extending therethrough between the upper surface 132 and the lower surface 134. Generally, the stationary platen 120 and the punch platen 130 can each have the same number of passageways 126, 136, respectively, and the same number of upper and lower shears 133, 135, respectively, as the number of forming die assemblies 150 contained in the press assembly 100.

Figure 12:
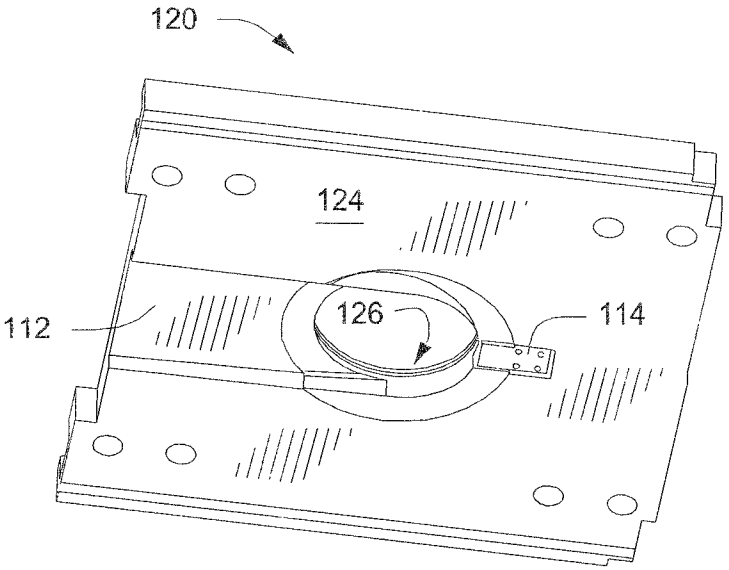
Figure 11:
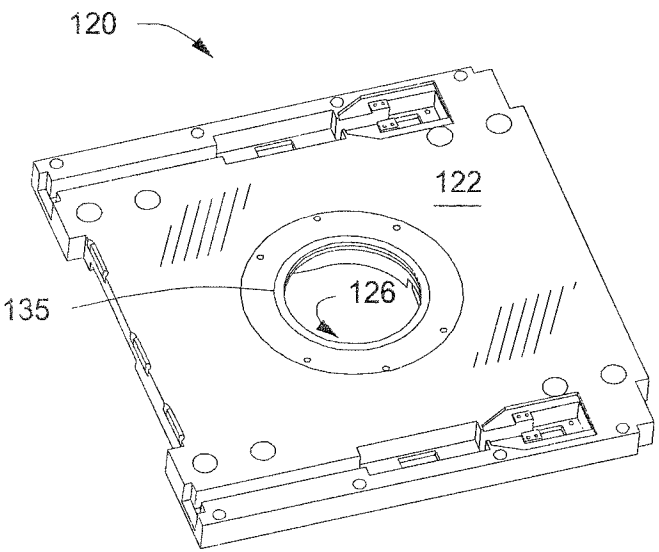

FIG. 11 depicts a top view of the stationary platen 120 with the upper surface 122. For each passageway 126, a lower shear 135 can be coupled or attached to the upper surface 122 and can be partially or completely disposed around the passageway 126. FIG. 12 depicts the nozzle 114 that can be disposed on or below the lower surface 124 of the stationary platen 120, as described in one or more embodiments. If two or more nozzles 114 are disposed on the lower surface 124, the nozzles 114 can be configured to blow, eject, or otherwise move two or more pressed products in opposite directions at the same time or at different times. The nozzles 114 can be configured to move two or more pressed products through the chute entrances 112 that can be disposed on or below the lower surface 124.

The press assembly 100 can include a plurality of the nozzles 114, the chute entrances 112, and the chutes 110, and can generally include the same number of each of the nozzles 114, the chute entrances 112, and the chutes 110, as the number of forming die assemblies 150 contained in the press assembly 100. The press assembly 100 can include one, two, three, four, five, six, seven, eight, nine, ten, eleven, twelve, thirteen, fourteen, fifteen, sixteen, seventeen, eighteen, nineteen, or twenty of each of the nozzles 114, the chute entrances 112, and/or the chutes 110. In some configurations, the press assembly 100 can include two to about twenty of the nozzles 114, the chute entrances 112, and/or the chutes 110, two to about twelve of the nozzles 114, the chute entrances 112, and/or the chutes 110, two to about ten of the nozzles 114, the chute entrances 112, and/or the chutes 110, or two to about seven of the nozzles 114, the chute entrances 112, and/or the chutes 110. In other examples, the press assembly 100 can include two to about six of the nozzles 114, the chute entrances 112, and/or the chutes 110. In other examples, the press assembly 100 can include two, three, or four of the nozzles 114, the chute entrances 112, and/or the chutes 110.

The upper moveable platen 140 can be disposed above the stationary platen 120 and can be configured to move toward and away from the upper surface 122 of the stationary platen 120. The lower moveable platen 160 can be disposed below the stationary platen 120 and can be configured to move toward and away from the lower surface 124 of the stationary platen 120. Each of the plurality of forming die assemblies 150 can include the upper forming die 170 coupled to the upper moveable platen 140, the lower forming die coupled to the lower moveable platen 160, and the upper forming die 170 and the lower forming die 180 configured to adjoin or otherwise come together within an individual passageway 126 of the plurality of passageways 126.

The punch platen 130 can be disposed between the upper moveable platen 140 and the stationary platen 120 and can be configured to move (e.g., vertically move) toward and away from the stationary platen 120. FIG. 10 depicts that the punch platen 130 has one shearing die 131, however, the punch platen 130 can include a plurality of shearing dies 131, and each shearing die 131 can include the upper shear 133 and the lower shear 135 as described above. The upper shear 133 can be coupled to the punch platen 130. The lower shear 135 can be coupled to the stationary platen 120 and can be partially or completely disposed around or encircling the individual passageway 126 at the upper surface 122, as depicted in FIG. 11. The upper shear 133 can be configured to move to at least partially extending into the individual passageway 126.

In one or more embodiments, a method for producing pressware can include pressing, forming, or otherwise producing the pressware product 92 between the upper and lower forming dies 170, 180 contained within the forming die assembly 150. The method can include retracting or moving at least a first portion of the upper forming die 170 away from the pressware product 92 and/or the lower forming die 180, and/or retracting or moving at least a first portion of the lower forming die 180 away from the upper forming die 170. The method can further include ejecting the pressware product 92 from the lower forming die 180 while feeding the web or paper 90, such as a web material, between the upper and lower forming dies 170, 180. The method can also include cutting a segment of the web or paper 90 to produce a blank or a substrate 82, and pressing the substrate 82 between the upper and lower forming dies 170, 180 to produce another pressware product 92.

In some embodiments, when ejecting the pressware product 92, the method can include moving at least a portion the upper forming die 170 and at least a portion of the lower forming die 180 in opposite directions from one another. The pressware product 92 can be ejected from the lower forming die 180 while disposed below the plane 123 of the web or paper 90 feeding between the upper and lower forming dies 170, 180. In some embodiments, when retracting at least the portion of the upper forming die 170 from the pressware product 92, the method can include retracting the forming punch 174 from the pressware product 92 while maintaining the pressure ring 172 in contact with the pressware product 92. In other embodiments, the method can include: (i) breaking contact between the pressure ring 172 and the pressware product 92 by moving the pressure ring 172 away from the pressware product 92 while maintaining the lower forming die 180 supporting the pressware product 92 stationary, (ii) moving the lower forming die 180 supporting the pressware product 92 away from the pressure ring 172 while maintaining the pressure ring 172 stationary, or (iii) moving the pressure ring 172 and the lower forming die 180 supporting the pressware product 92 away from each other. The method can also include moving the upper forming die 170 and the lower forming die 180 in reciprocating and opposite directions perpendicular to the plane 123 of the web or paper 90 therebetween.

In some embodiments, when ejecting the pressware product 92 from the lower forming die 180, the method can further include moving the lower forming die 180 supporting the pressware product 92 away from the upper forming die 170, lifting the pressware product 92 with at least a portion of the lower forming die 180, and exposing the pressware product 92 to a gaseous flow to eject the pressware product 92 from the portion of the lower forming die 180. In some examples, the portion of the lower forming die 180 can be the lower knockout 184 and the pressware product 92 can be ejected from the lower knockout 184 while at a position below the plane 123 of the web or paper 90 feeding between the upper and lower forming dies 170, 180. In other embodiments, when feeding the web or paper 90 between the upper and lower forming dies 170, 180, the method can also include lifting the stripper plate 138 from the web or paper 90, feeding the web or paper 90, and indexing the web or paper 90 to provide the segment of web material.

In other embodiments, the method can further include producing two or more pressware products 92 per process cycle with two or more of the forming die assemblies 150 disposed on any of the press assemblies, such as press assemblies 100-300. In some examples, the press assemblies 100-300 can include three forming die assemblies 150 to about twelve forming die assemblies 150. Each forming die assembly 150 can produce about 80 pressware products per minute to about 120 pressware products per minute. The pressware products 92 can contain paper, paperboard, pulp fiber, fibrous materials, plastic or polymeric materials, natural or synthetic materials, or any mixture thereof. The pressware products 92 can have various geometries, shapes, or designs including circular, round, oval, ellipsoid, rectangular, square, polygonal, or other geometries, shapes, or designs. The pressware products 92 can be plates, saucers, bowls, buckets, trays, cutting boards, containers, or other pressware items. In some examples, the pressware products 92 can be round plates that have a diameter of about 4 inches, about 5 inches, about 6 inches, about 7 inches, about 8 inches, about 9 inches, about 10 inches, about 11 inches, or about 12 inches, or greater. In other examples, the pressware products 92 can be trays or cutting boards that are polygonal having a major axis and a minor axis where the major axis or the minor axis can be independently about 4 inches, about 5 inches, about 6 inches, about 7 inches, about 8 inches, about 9 inches, about 10 inches, about 11 inches, about 12 inches, about 13 inches, about 14 inches, about 15 inches, or about 16 inches.

In one or more embodiments, a method for producing pressware can include feeding the web or paper 90 between the upper and lower forming dies 170, 180 moving in reciprocating and opposite directions from each other. The method can also include cutting a segment of the web or paper 90 to produce the blank or substrate 82, and pressing the substrate 82 between the upper and lower forming dies 170, 180 to produce another pressware product 92. The method can further include ejecting the pressware product 92 from the lower forming die 180 while at a position below the plane 123 of the web or paper 90 feeding between the upper and lower forming dies 170, 180. In some examples, at least a portion of feeding the web or paper 90 and at least a portion of ejecting the pressware product 92 can occur at the same time or at least overlap in time.

In one or more embodiments, a method for producing pressware can include producing a first pressware product 92 within a forming die assembly 150 having the upper forming die 170 and the lower forming die 180. The method can include moving the upper moveable platen 140 and the lower moveable platen 160 in reciprocating and opposite directions perpendicular to the plane of the web or paper 90. The upper moveable platen 140 can include the upper forming die 170 and the lower moveable platen 160 can include the lower forming die 180. The first pressware product 92 can contain a web or paper 90. The method can include retracting the upper forming die 170 from the first pressware product 92, and moving the first pressware product 92 from the lower forming die 180 while feeding the web or paper 90 between the upper forming die 170 and the lower forming die 180. The method can also include cutting a segment of the web or paper 90 to produce a blank or a substrate 82 and pressing the substrate 82 between the upper forming die 170 and the lower forming die 180 to produce a second pressware product 92.

In some embodiments, the method for feeding the segment of the web or paper 90 between the upper and lower forming dies 170, 180 can include lifting a stripper plate 138 from the web or paper 90, feeding the web or paper 90, and indexing the web or paper 90 to provide the segment of web or paper 90. In other embodiments, the method can also include moving the upper forming die 170 and the lower forming die 180 in opposite directions from one another to extract the first pressware product 92. In one example, the method for moving the first pressware product 92 from the lower forming die 180 can include retracting at least a portion of the upper forming die 170, such as the forming punch 174, from the first pressware product 92 while maintaining at least another portion of the upper forming die 170, such as the pressure ring 172, in contact with the first pressware product 92. The method for moving the first pressware product 92 from the lower forming die 180 can also include lifting the first pressware product 92 with a lower knockout 184, blowing the first pressware product 92 with a gas, and ejecting the first pressware product 92 below a web path or a web line 123 (e.g., plane of the incoming web, paper, paperboard, or like material) of the web or paper 90. The upper surface 122 of the stationary platen 120 can be configured to receive the web or paper 90 from the feeder 80 along the web line 123 and can be configured to remove or eject a webbing scrap from the forming die assembly 150 along the web line 123.

Figure 13:
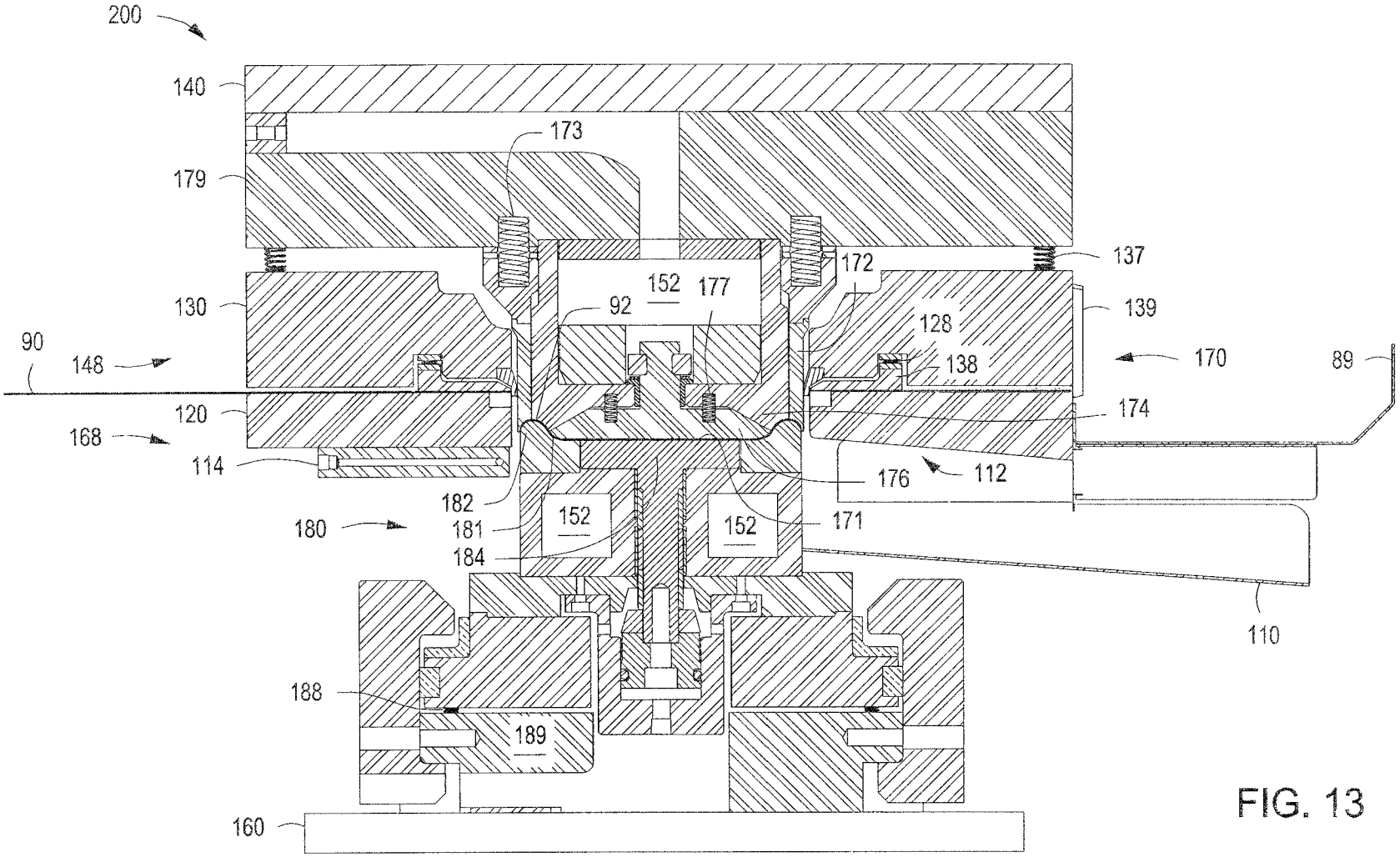
FIGS. 13-21 depict perspective views of another press assembly at different stages during a process cycle, according to one or more embodiments described.

FIGS. 13-21 depict perspective views of the press assembly 200 at different stages during a process cycle for producing pressware products, according to one or more embodiments. FIG. 13 depicts the press assembly 200 at the start of the process cycle and at the end of the process cycle, and FIGS. 14-21 depict the press assembly 200 through the progression of multiple stages of the process cycle. Referring back to FIG. 13, the press assembly 200 is depicted at the end of the process cycle and at the starting point of the next process cycle. The starting or initial points and the ending or final points of the process cycle are arbitrary reference points throughout an exemplary process cycle. Any point of the process cycle depicted or not shown in FIGS. 13-21 can be used as the starting or ending point of the process cycle. Each of the views of the press assembly 200 in FIGS. 13-21 depicts a single stage of a process cycle for one exemplary method and configuration of the press assembly 200. Other views and embodiments of the press assembly 200 that are not shown in FIGS. 13-21 can be derived at different intervals of the process cycle, and other exemplary methods with or lacking optional steps can be derived at different intervals of the process cycle. The press assembly 200 can include and/or can be coupled with the same components or modified components as the press assembly 100 and/or the pressware system 50, as depicted in FIG. 1. For example, in one or more embodiments, not shown, the pressware system 50 can include the press assembly 200 instead of the press assembly 100 and the system controller 70 can be operatively coupled to one or more components of the paper feed system 60 and the press assembly 200.

The press assembly 200 is depicted with one forming die assembly 150 (such as the press assembly 100 depicted in FIGS. 1-12) and therefore can generate one pressware product per process cycle. However, the press assembly 200 can include two or more forming die assemblies 150 can generate the respective number of pressware products per process cycle. For example, the press assembly 200 can include two forming die assemblies 150 and can generate two pressware products per process cycle. In other examples, the press assembly 200 can also include three, four, five, six, seven, eight, nine, ten, eleven, twelve, thirteen, fourteen, fifteen, sixteen, seventeen, eighteen, nineteen, or twenty forming die assemblies 150 and can generate three, four, five, six, seven, eight, nine, ten, eleven, twelve, thirteen, fourteen, fifteen, sixteen, seventeen, eighteen, nineteen, or twenty pressware products per process cycle, respectively.

In one or more embodiments, in FIG. 13, the upper moveable platen 140 and the lower moveable platen 160 are depicted in initial positions which are as close to the stationary platen 120 as the upper moveable platen 140 and the lower moveable platen 160 will be during the process cycle. The incoming web or paper 90 is illustrated disposed on the stationary platen 120 and between the upper tool assembly 148 and the lower tool assembly 168. The punch platen 130 is depicted adjacent to the stationary platen 120 so that the stripper plate 138 can be maintained to apply pressure or force to the incoming web or paper 90. The stripper plate 138 can tighten the area of the incoming web or paper 90 to be later cut. The cutting tool 139, such as a blade, a scrap knife, or another type of blade or cutting instrument, can be disposed on the punch platen 130 and can be configured to severe or cut the webbing scrap 91 that exits from between the punch platen 130 and the stationary platen 120. The cutting tool 139 is depicted in a downward or post-cut position. The upper forming die 170 and the lower forming die 180 are illustrated as being adjoined with a pressware product 92 formed therebetween. The lower surfaces of the pressure ring 172, the forming punch 174, and the upper knockout 176 of the upper forming die 170 are illustrated forming the upper profile 171 and contacting the upper surface of the pressware product 92. Similarly, the upper surfaces of the contour rim 182 and the lower knockout 184 of the lower forming die 180 are illustrated forming the lower profile 181 and contacting the lower surface of the pressware product 92. The upper knockout springs 177, the pressure ring springs 173, the stripper plate springs 128, the punch springs 137, and the lower forming springs 188 are depicted as fully compressed as will be during the process cycle.

Figure 14:
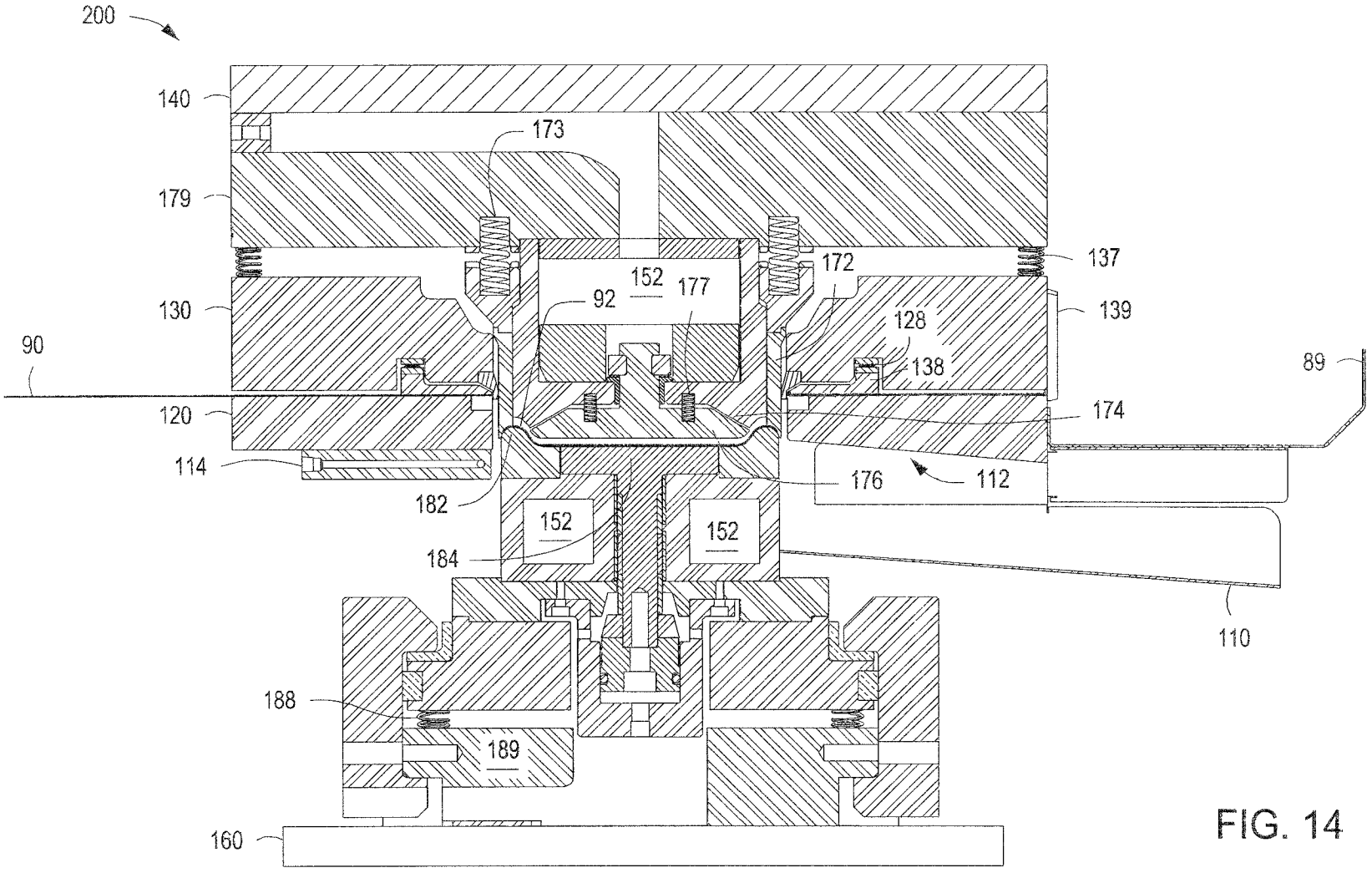

In FIG. 14, the upper moveable platen 140 and the lower moveable platen 160 are depicted as retracted or moved away from the stationary platen 120, and the punch platen 130 is depicted as being maintained in the same positions, relative to as shown in FIG. 13. The forming punch 174 and the upper knockout 176 are shown retracted from the pressware product 92, but the pressure ring 172 is illustrated as contacting the upper surface of the pressware product 92. The upper knockout springs 177 are depicted to be at least partially decompressed or decompressed. The pressure ring springs 173 are depicted to be at least partially decompressed. The pressure ring 172 is illustrated contacting the upper surface of the pressware product 92. The stripper plate springs 128 are depicted to be at least partially or fully compressed. The contour rim 182 and the lower knockout 184 are illustrated as contacting the lower surface of the pressware product 92 and the lower forming springs 188 are shown decompressed. In some examples, the lower forming springs 188 are shown at maximum extension for decompression.

Figure 15:
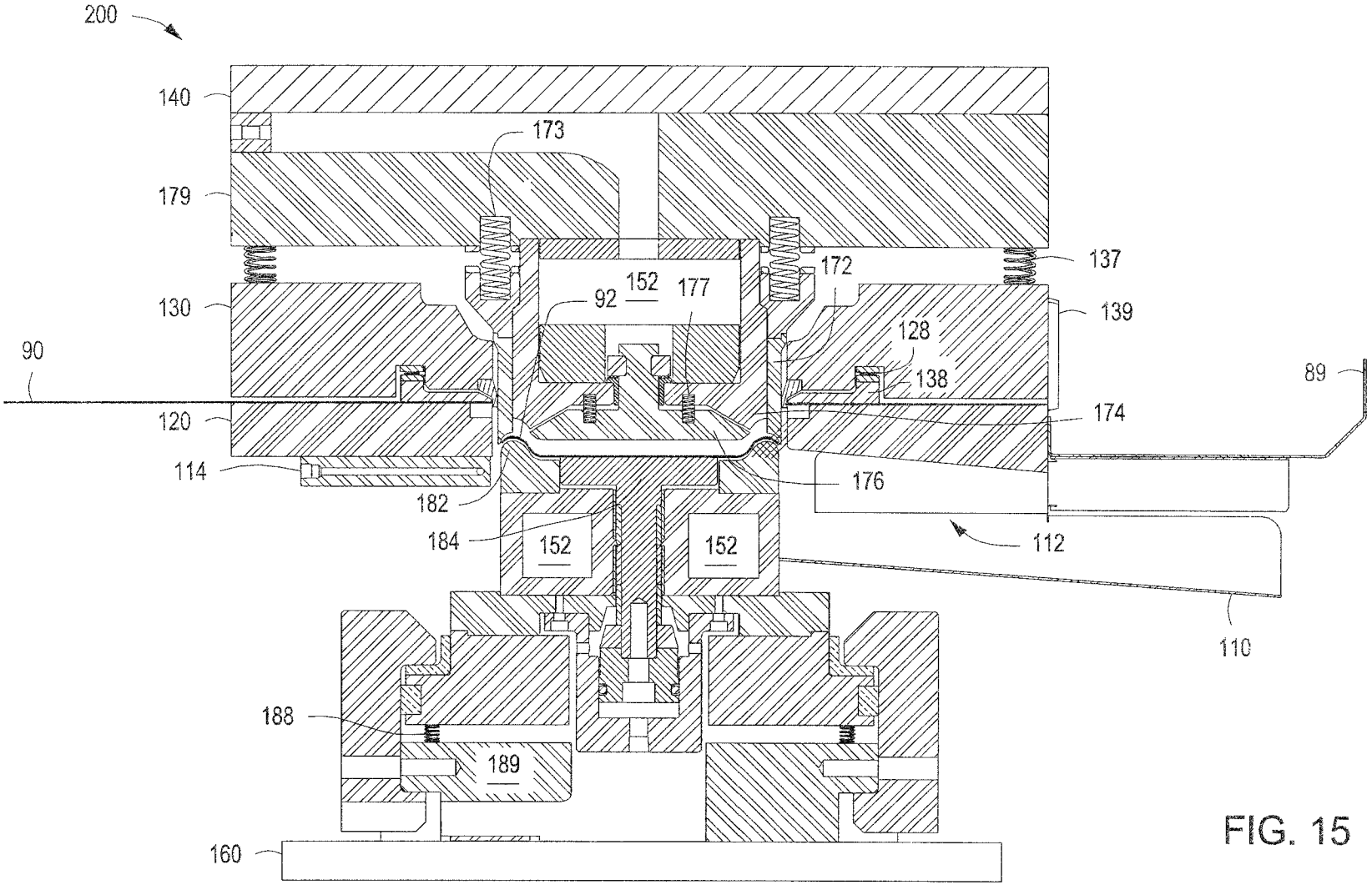

In FIG. 15, the upper moveable platen 140 and the lower moveable platen 160 are depicted as retracted or moved away from the stationary platen 120, and the punch platen 130 is depicted as being maintained in the same positions, relative to as shown in FIG. 14. The pressure ring 172 is illustrated to be separate from the pressware product 92. The upper knockout springs 177, the pressure ring springs 173, and the lower forming springs 188 are shown decompressed. The stripper plate springs 128 are depicted to be at least partially or fully compressed. The pressware product 92 is illustrated as supported by the contour rim 182 and the lower knockout 184.

Figure 16:
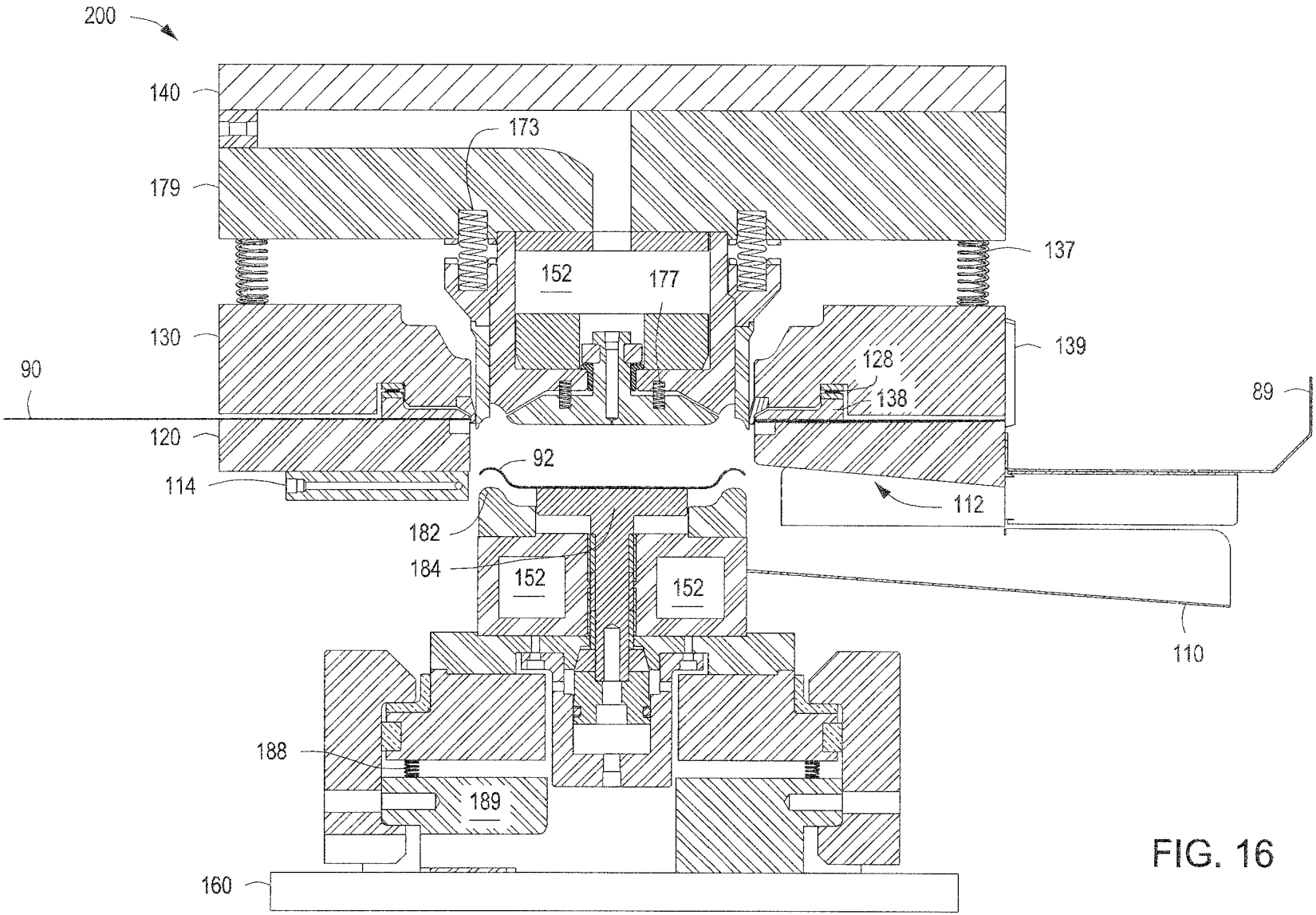

In FIG. 16, the upper moveable platen 140 and the lower moveable platen 160 are depicted as further retracted or moved away from the stationary platen 120, and the punch platen 130 is depicted as being maintained in the same position, relative to as shown in FIG. 15. The stripper plate springs 128 are depicted to be at least partially compressed. In one or more embodiments, the lower knockout 184 is illustrated as extended away from the lower moveable platen 160 towards the stationary platen 120 and contacting the pressware product 92 during the ejection process of the pressware product 92. The contour rim 182 is shown separated from the pressware product 92. The pressware product 92 is illustrated disposed on the lower knockout 184, aligned horizontally or substantially horizontally with the nozzles 114, and disposed between the nozzles 114 and the chute 110. Ejection or movement of the pressware products 92 can include movement transferred from the lower knockout 184 to the pressware products 92, gaseous flow or burst from the nozzles 114 carrying or moving the pressware products 92, or a combination thereof. In some embodiments, the ejection or movement of the pressware products 92 can include one or more mechanical or physical members (not shown) to push, thrust, or otherwise move the pressware products 92 from the lower knockout 184 or another portion of the lower forming die 180. The one or more mechanical or physical members can move the pressware products 92 to the one or more chutes 110.

Figure 17:
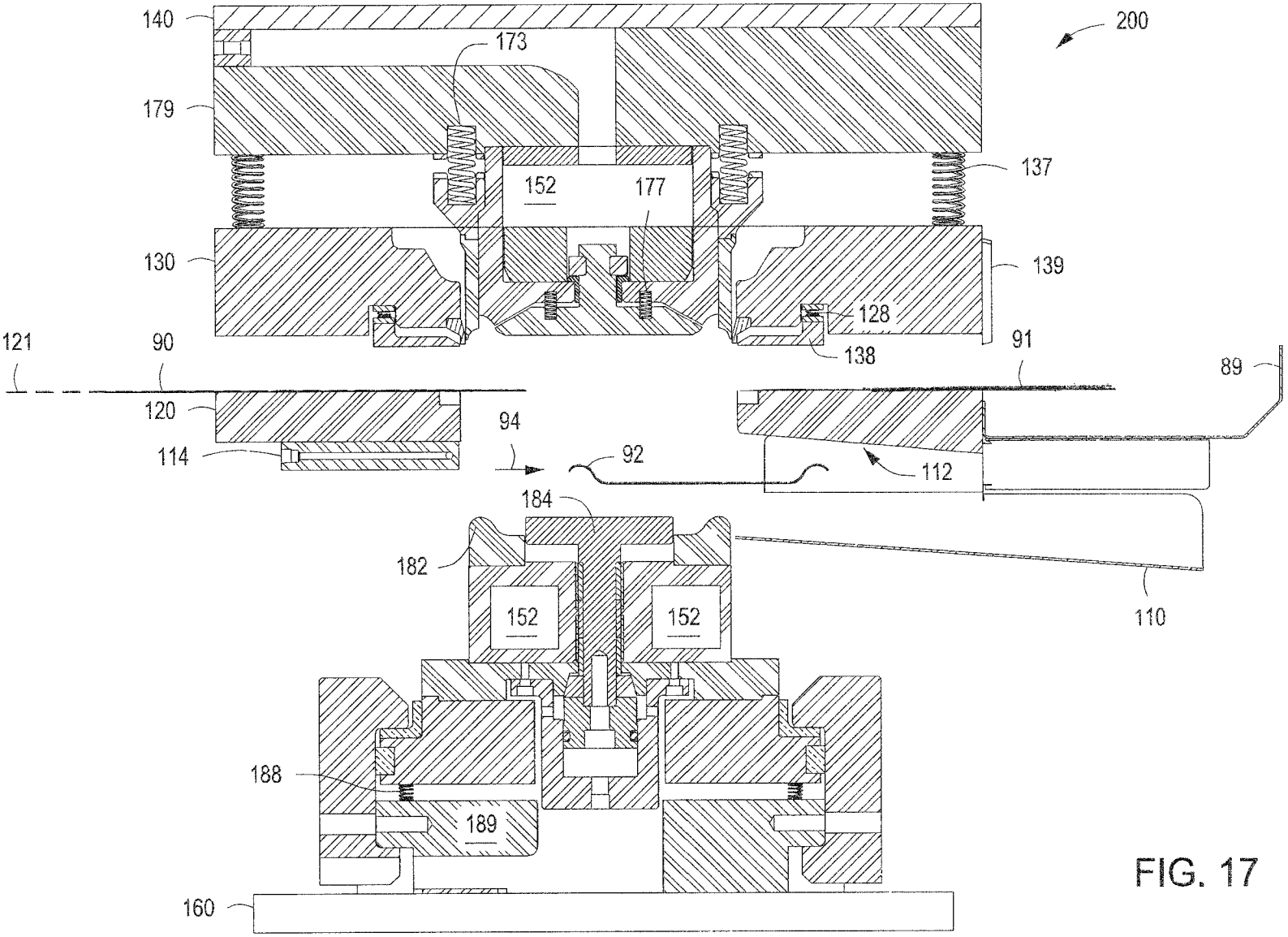

In FIG. 17, the upper moveable platen 140 and the lower moveable platen 160 are depicted as further retracted or moved away from the stationary platen 120, and the punch platen 130 is depicted to have also been moved away from the stationary platen 120, relative to as shown in FIG. 16. The punch platen 130 is shown moved so that the stripper plate 138 is separated from the incoming web or paper 90 during the paper feed process. The stripper plate springs 128 are depicted in a decompressed state in FIG. 17. Also, the cutting tool 139 is shown moved and positioned in an upward or pre-cut position above the outgoing webbing scrap 91. The incoming web or paper 90 is depicted disposed between the stationary platen 120 and the punch platen 130 and the outgoing webbing scrap 91 is shown ejected out the opposite side of the press assembly 200 as the web or paper 90 entered. One more waste chutes 89 or other containers for receiving the webbing scraps 91 can be coupled to the press assembly 200 below the web line 123 such that the outgoing webbing scrap 91 can be ejected into the waste chute 89. The incoming web or paper 90 and the outgoing webbing scrap 91 are shown disposed along the web line 123. A pressurized burst of fluid or gas or a gas stream 94 is shown by arrows as coming from the nozzles 114 and directed towards the pressware product 92 and below the web line 123 during the ejection of the pressware product 92. The pressware product 92 is illustrated as being transported by the gas stream 94 from the lower knockout 184 to the chute 110 via the chute entrance 112 and below the web line 123.

Figure 18:
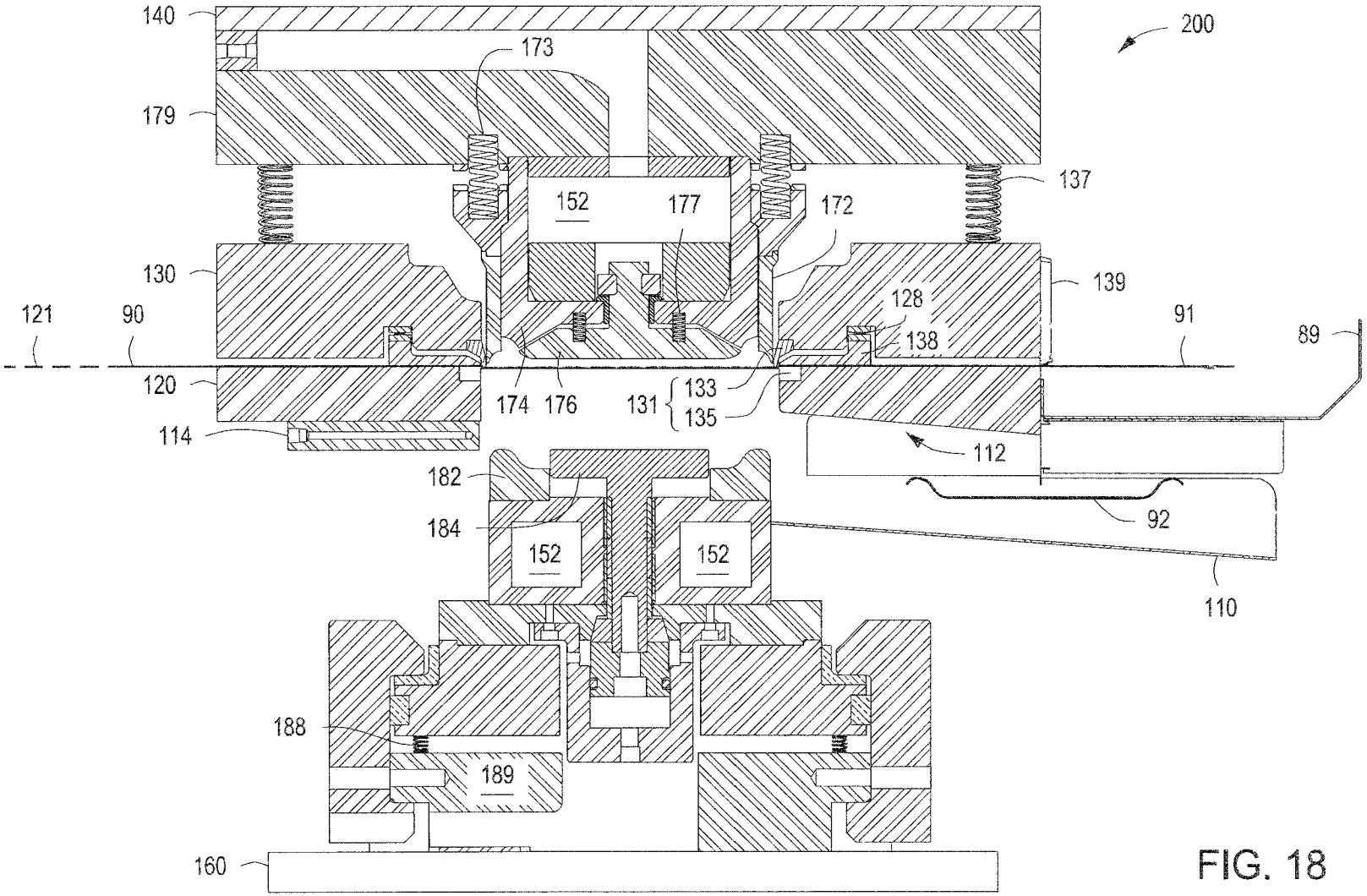

In FIG. 18, the upper moveable platen 140, the punch platen 130, and the lower moveable platen 160 are depicted as being moved toward the stationary platen 120, relative to as shown in FIG. 17. The web or paper 90 is illustrated as fed through and between the upper forming die 170 and the lower forming die 180. The pressure ring 172 is shown above and separated from the web or paper 90. The stripper plate 138 is shown contacting the web or paper 90. The stripper plate 138 is illustrated applying pressure to and tightening the web or paper 90 so that the web or paper 90 can be easier to cut substrates 82 therefrom. The stripper plate springs 128 are depicted to be at least partially compressed or fully compressed. The cutting tool 139 is shown contacting the webbing scrap 91 and in starting to transition from the upward or pre-cut position to the downward or post-cut position. The webbing scrap 91 is depicted protruding from the press assembly 200 and above the waste chute 89. The upper shear 133 and the lower shear 135 of the shearing die 131 are illustrated contacting the web or paper 90 passing therethrough along the web line 123 during the cutting process of the web or paper 90. The pressware product 92 is illustrated disposed in the chute 110 below the web line 123. The upper knockout springs 177, the pressure ring springs 173, the punch springs 137, and the lower forming springs 188 are depicted as decompressed.

Figure 19:
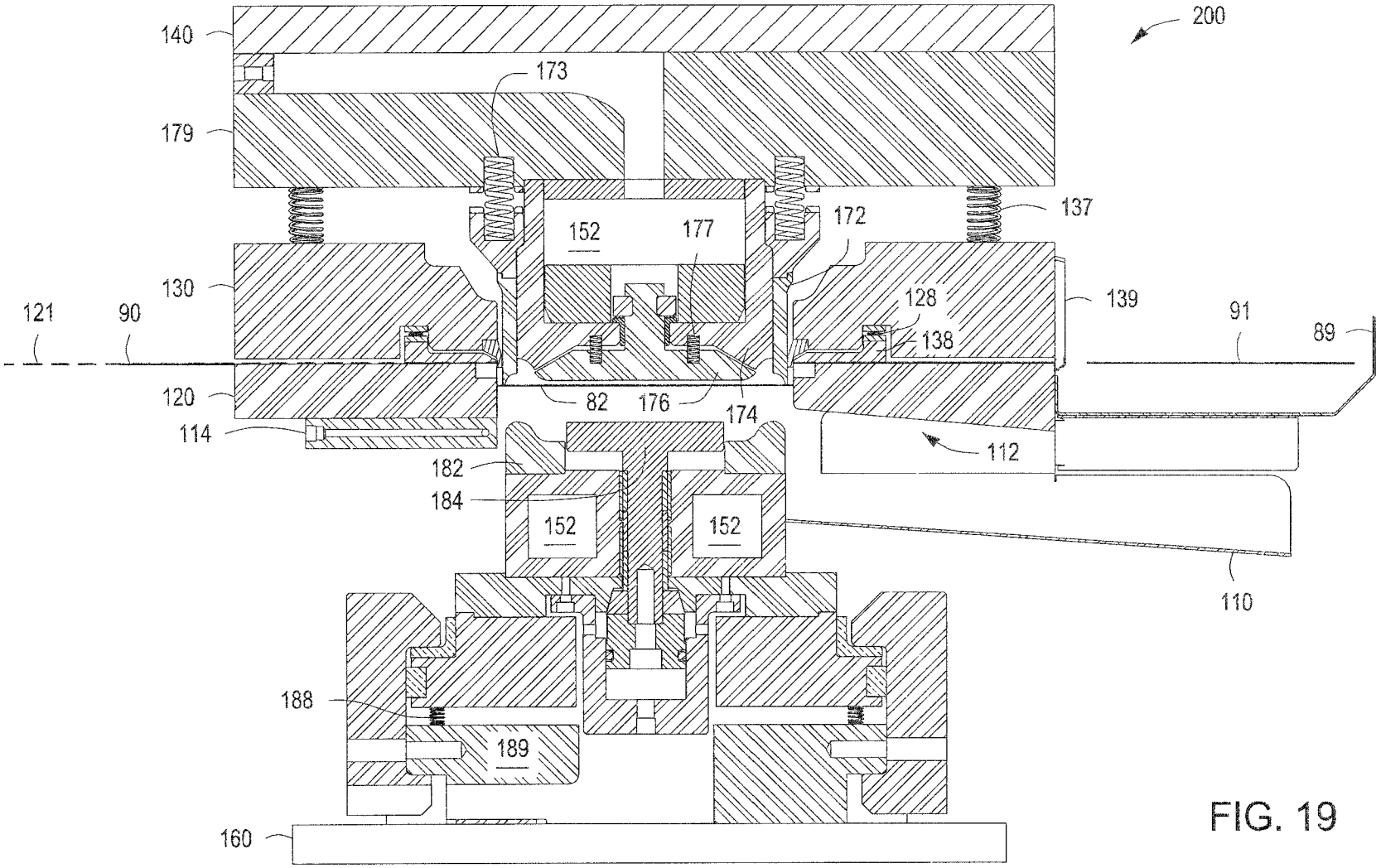

In FIG. 19, the upper moveable platen 140, the punch platen 130, and the lower moveable platen 160 are depicted as being further moved toward the stationary platen 120, relative to as shown in FIG. 18. The web or paper 90 is shown cut by the shearing die 131 to produce the blank or substrate 82. The substrate 82 is illustrated as being transported from the shearing die 131 towards the lower knockout 184 by the pressure ring 172. The cutting tool 139 is shown in a further downward position and cutting the webbing scrap 91 from the remaining web or paper 90. The webbing scrap 91 can be collected in the waste chute 89 once severed by cutting tool 139. The upper knockout springs 177, the pressure ring springs 173, and the lower forming springs 188 are depicted as decompressed, and the punch springs 137 are depicted as being at least partially compressed. The stripper plate springs 128 are depicted to be at least partially compressed or fully compressed.

Figure 20:
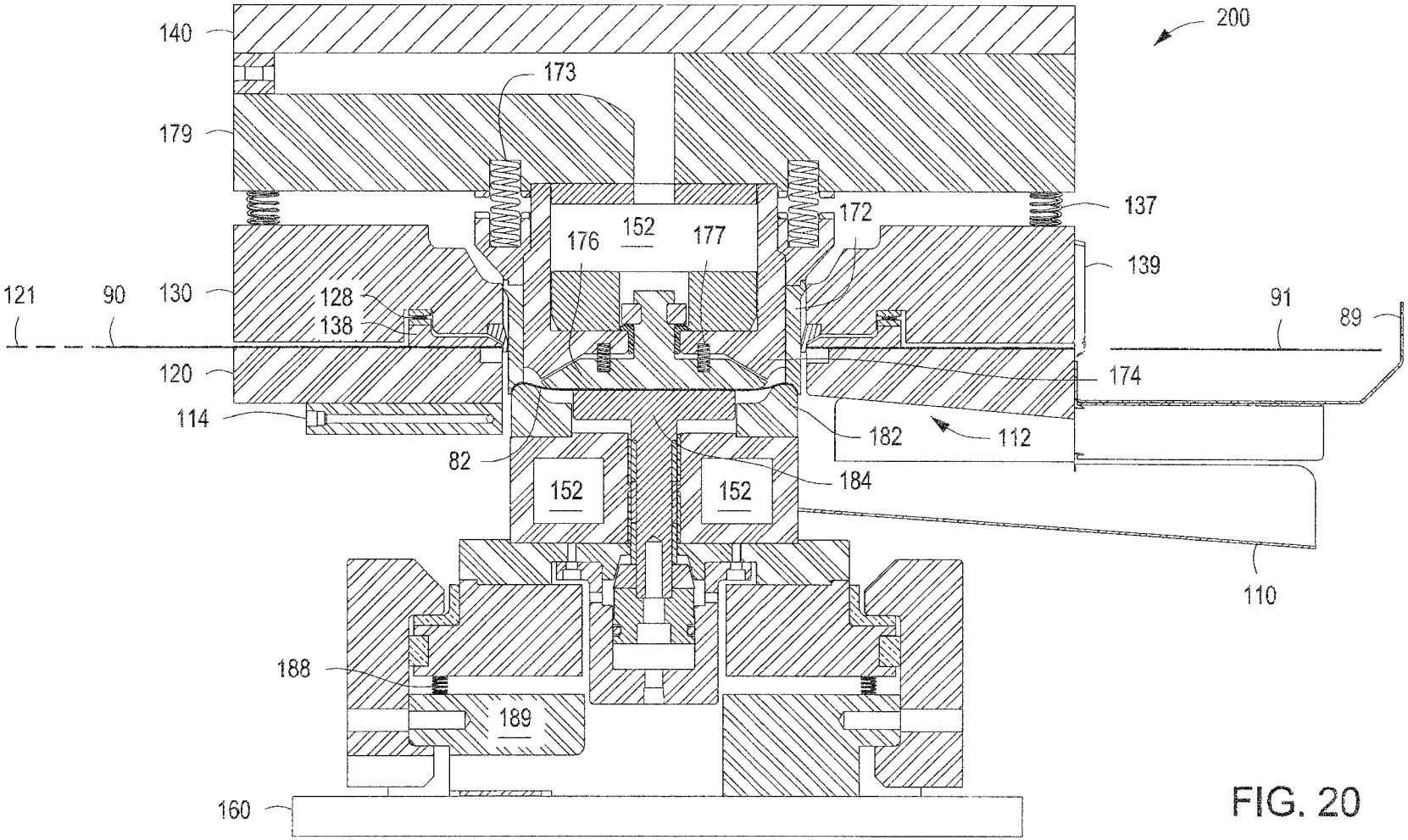

In FIG. 20, the upper moveable platen 140 and the lower moveable platen 160 are depicted as being further moved toward the stationary platen 120, and the punch platen 130 is depicted as being maintained in the same position, relative to as shown in FIG. 19. The substrate 82 is illustrated as being transported to the lower knockout 184 by the pressure ring 172. The pressure ring 172 is shown forming an edge of the substrate 82 via the contour rim 182. The lower knockout 184 is illustrated extended from the contour rim 182. Also, the upper knockout 176 and the lower knockout 184 are depicted contacting the substrate 82, but the forming punch 174 is depicted separated from the substrate 82. The cutting tool 139 is shown in the downward or post-cut position and the webbing scrap 91 is illustrated as severed and ejecting below the web line 123. The punch springs 137 and the pressure ring springs 173 are depicted as being at least partially compressed. The stripper plate springs 128 are depicted to be at least partially or fully compressed.

Figure 21:
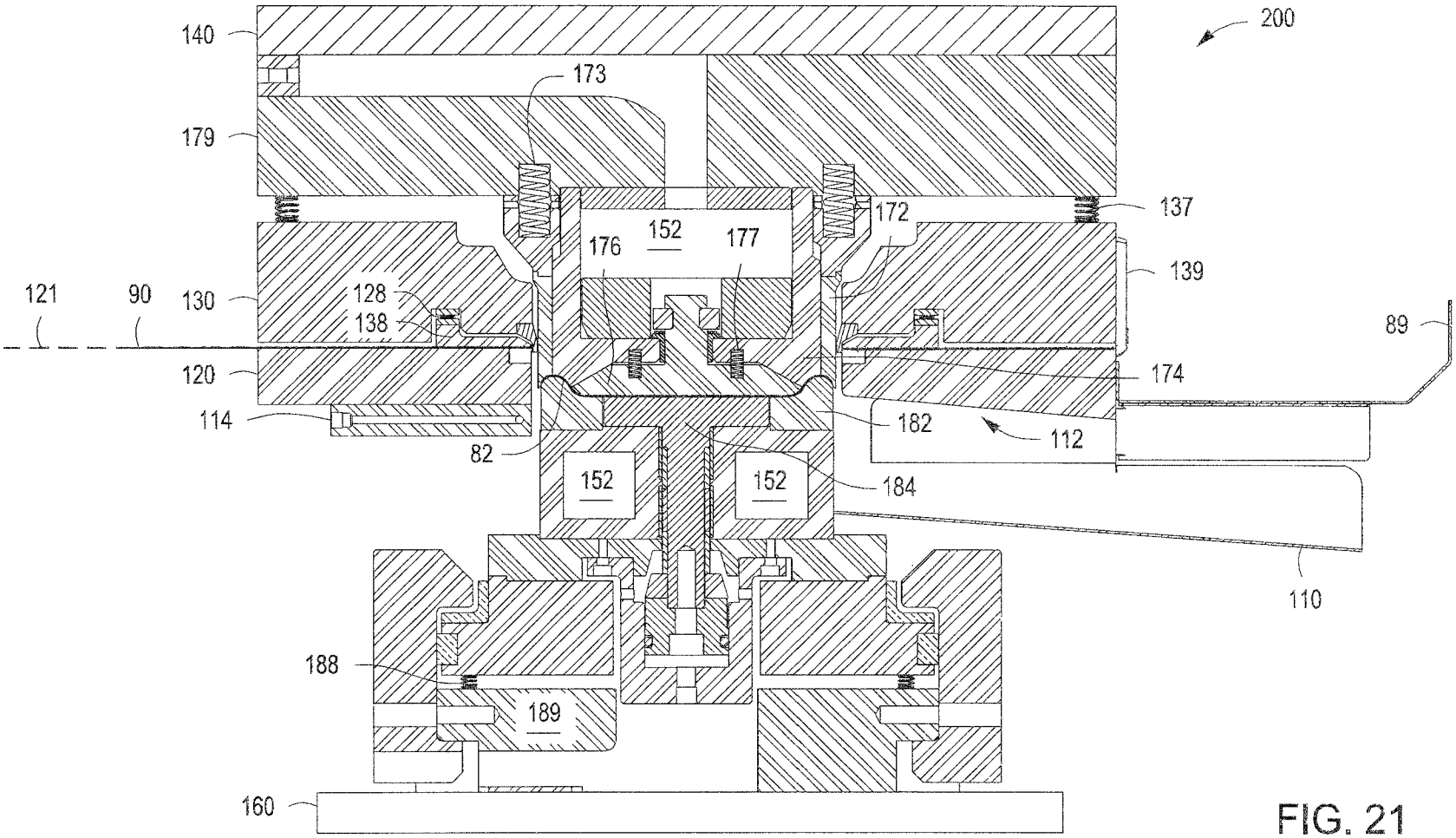

In FIG. 21, the upper moveable platen 140 and the lower moveable platen 160 are depicted as being further moved toward the stationary platen 120, and the punch platen 130 is depicted as being maintained in the same position, relative to as shown in FIG. 20. The substrate 82 is illustrated as being shaped between the upper forming die 170 and the lower forming die 180. The pressure ring 172 is shown pressing the edge of the substrate 82 against the contour rim 182. Similarly, the forming punch 174 and the upper knockout 176 are depicted pressing the substrate 82 against the contour rim 182 and the lower knockout 184. The stripper plate springs 128, the punch springs 137, the pressure ring springs 173, and the upper knockout springs 177 are depicted as being fully compressed, and the lower forming springs 188 are depicted as being at least partially compressed.

Referring back to FIG. 13, the upper moveable platen 140 and the lower moveable platen 160 are depicted as being further moved toward the stationary platen 120, relative to as shown in FIG. 21, and the punch platen 130 is depicted as being maintained in the same position. The punch springs 137, the pressure ring springs 173, the upper knockout springs 177, and the lower forming springs 188 are depicted as being fully compressed. The pressware product 92 is illustrated as formed between the upper forming die 170 and the lower forming die 180 from the substrate 82 as one cycle of the process cycle is completed and the next cycle begins.

Figure 22:
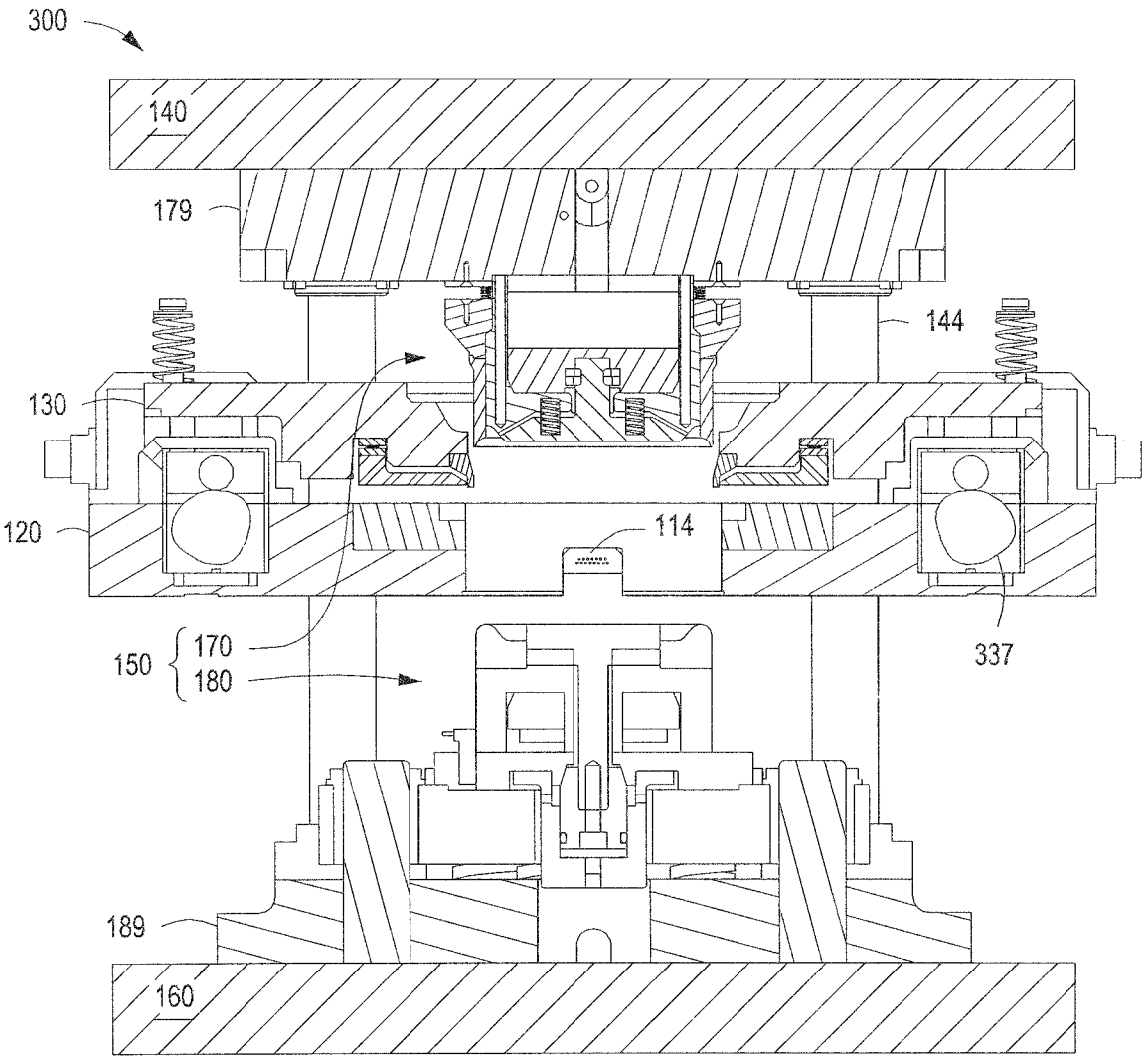
FIG. 22 depicts a perspective view of another press assembly, according to one or more embodiments described.

FIG. 22 depicts a perspective view of a press assembly 300, according to one or more embodiments. The press assembly 300 can include the stationary platen 120 and the punch platen 130 disposed between the upper moveable platen 140 and the lower moveable platen 160. The punch platen 130 can be disposed between the upper moveable platen 140 and the stationary platen 120. The upper forming die 170 and the lower forming die 180 of the forming die assembly 150 can be coupled with the upper moveable platen 140 and the lower moveable platen 160, respectively. The press assembly 300 can include and/or can be coupled with the same components or modified components as any of the press assemblies 100 or 200, the pressware system 50, and/or the system controller 70, but can include the same, different, and/or additional extendable members, similar to the punch springs 137, for controlling movement of the punch platen 130 relative to the stationary platen 120 and/or the upper moveable platen 140.

The press assembly 300 can include one or more extendable members 337 configured to extend or retract the punch platen 130 to and from the stationary platen 120 and/or to maintain a stationary position between the upper moveable platen 140 and the stationary platen 120. The one or more extendable members 337 can be configured to control at least a portion of the movement by the punch platen 130, such that the portion of movement can be independent of the upper moveable platen 140. In some embodiments, one end of the extendable member 337 can be coupled to the punch platen 130 and the other end of the extendable member 337 can be coupled to the stationary platen 120, as depicted in FIG. 22. The extendable member 337 can include one, two, or more extendable members, including, for example, but not limited to, mechanical extendable members, hydraulic extendable members, pneumatic extendable members, or any combination thereof. The extendable member 337 can be or include one or more cams, rams, actuators, pistons, shafts, rods, arms, guides, springs, rack and pinion systems, springs, or combinations thereof. In some examples, the extendable member 337 can be a hydraulic cam or a pneumatic cam. A system controller, not shown, but as described for the system controller 70 illustrated in FIG. 1, can be operatively coupled to the extendable members 337 for controlling the movement of the punch platen 130. For example, in one or more embodiments, the pressware system 50 can include the press assembly 300 instead of the press assembly 100 and the system controller 70 can be operatively coupled to one or more components of the paper feed system 60 and the press assembly 300.

In other embodiments, not shown, one end of the extendable member 337 can be coupled to the punch platen 130 and the other end of the extendable member 337 can be coupled to the upper moveable platen 140. In other embodiments, not shown, one end of the extendable member 337 can be coupled to the punch platen 130 and the other end of the extendable member 337 can be directly or indirectly coupled to the support structure, housing, or other portion of the press assembly 300 or the pressware system 50 or another device outside of the press assembly 300 or the pressware system 50.

The press assemblies 100-300 are depicted throughout the description and drawings in a "vertical position"—such that the upper moveable platen 140 is disposed above the plane of the stationary platen 120 and the lower moveable platen 160 is disposed below the plane of the stationary platen 120. Also, the plane of the web line 123 is depicted horizontally extending along the plane of the stationary platen 120. However, in other embodiments, not shown in the drawings, the press assemblies 100-300 can also be disposed in other positions besides the "vertical position"—such as a "horizontal position"—in which the upper moveable platen 140 and the lower moveable platen 160 can be configured to horizontally move toward and away from the plane of the stationary platen 120 and the plane of the web line 123 can vertically extend along the plane of the stationary platen 120. In other embodiments, not shown in the drawings, the press assemblies 100-300 can also be disposed in other positions besides the "vertical position" or "horizontal position"—such as at any desired angle therebetween—in which the upper moveable platen 140 and the lower moveable platen 160 can be configured to move toward and away from the plane of the stationary platen 120 at the desired angle and the plane of the web line 123 can extend along the plane of the stationary platen 120 at another angle that can be perpendicular of substantially perpendicular to the desired angle of the movements of the upper moveable platen 140 and the lower moveable platen 160.

Other embodiments relate to any one or more of the following paragraphs:

1. A method for producing pressware, comprising: producing a pressware product between an upper forming die and a lower forming die contained within a forming die assembly; retracting at least a portion of the upper forming die from the pressware product; ejecting the pressware product from the lower forming die while feeding a web material between the upper forming die and the lower forming die; cutting a segment of the web material to produce a substrate; and pressing the substrate between the upper forming die and the lower forming die to produce another pressware product.

2. The method of paragraph 1, wherein ejecting the pressware product further comprises moving at least a portion the upper forming die and at least a portion of the lower forming die in opposite directions from one another.

3. The method of paragraph 1 or 2, wherein the pressware product is ejected from the lower forming die while disposed below the plane of the web material feeding between the upper forming die and the lower forming die.

4. The method according to any one of paragraphs 1-3, wherein retracting at least the portion of the upper forming die from the pressware product comprises: retracting a forming punch from the pressware product while contacting the pressware product with a pressure ring.

5. The method of paragraph 4, further comprising breaking contact between the pressure ring and the pressware product by: moving the pressure ring away from the pressware product while supporting the pressware product stationary with the lower forming die; moving the lower forming die supporting the pressware product away from the pressure ring while the pressure ring is stationary; or moving the pressure ring and the lower forming die supporting the pressware product away from each other.

6. The method according to any one of paragraphs 1-5, wherein ejecting the pressware product from the lower forming die further comprises: moving the lower forming die supporting the pressware product away from the upper forming die; lifting the pressware product with at least a portion of the lower forming die; and exposing the pressware product to a gaseous flow to eject the pressware product from the portion of the lower forming die.

7. The method of paragraph 6, wherein the portion of the lower forming die is a lower knockout and the pressware product is ejected from the lower knockout while at a position below the plane of the web material feeding between the upper forming die and the lower forming die.

8. The method according to any one of paragraphs 1-7, wherein feeding the web material between the upper forming die and the lower forming die further comprises: lifting a stripper plate from the web material; feeding the web material; and indexing the web material to provide the segment of web material.

9. The method according to any one of paragraphs 1-8, further comprising moving the upper forming die and the lower forming die in reciprocating and opposite directions perpendicular to the plane of the web material therebetween.

10. The method according to any one of paragraphs 1-9, further comprising producing two or more pressware products per process cycle with two or more of the forming die assemblies disposed on a press assembly.

11. The method of paragraph 10, wherein the press assembly comprises three forming die assemblies to about twelve forming die assemblies.

12. The method of paragraph 11, wherein each forming die assembly produces about 80 pressware products per minute to about 120 pressware products per minute.

13. The method of paragraph 10, wherein the pressware products are plates, bowls, trays, or cutting boards and comprise paper, paperboard, pulp fiber, fibrous materials, plastic or polymeric materials, natural or synthetic materials, or any mixture thereof.

14. A method for producing pressware, comprising: pressing a substrate between an upper forming die and a lower forming die to produce a pressware product; moving at least a first portion of the upper forming die away from the lower forming die; moving at least a first portion of the lower forming die away from the upper forming die; ejecting the pressware product from the lower forming die while feeding a web material between the upper forming die and the lower forming die; cutting a segment of the web material to produce another substrate; and pressing the produced substrate between the upper forming die and the lower forming die to produce another pressware product.

15. The method of paragraph 14, wherein moving at least the first portion of the upper forming die away from the lower forming die further comprises: retracting a forming punch away from the pressware product while contacting the pressware product with a pressure ring.

16. The method of paragraph 14 or 15, further comprising retracting an upper knockout and the forming punch away from the pressware product while contacting the pressware product with a pressure ring.

17. The method of paragraph 16, wherein moving at least a first portion of the lower forming die away from the upper forming die further comprises: retracting a contour rim and a lower knockout supporting the pressware product away from the pressure ring.

18. The method according to any one of paragraphs 14-17, wherein ejecting the pressware product from the lower forming die further comprises: moving the lower forming die supporting the pressware product away from the upper forming die; lifting the pressware product with at least a lower knockout; and exposing the pressware product to a gaseous flow to eject the pressware product from the lower knockout, wherein the pressware product is ejected from the lower knockout while at a position below the plane of the web material feeding between the upper forming die and the lower forming die.

19. The method according to any one of paragraphs 14-18, wherein feeding the web material between the upper forming die and the lower forming die further comprises: lifting a stripper plate from the web material; feeding the web material; and indexing the web material to provide the segment of web material.

20. A method for producing pressware, comprising: feeding a web material between an upper forming die and a lower forming die moving in reciprocating and opposite directions from each other; cutting a segment of the web material to produce a substrate; pressing the substrate between the upper forming die and the lower forming die to produce another pressware product; and ejecting the pressware product from the lower forming die while at a position below the plane of the web material feeding between the upper forming die and the lower forming die, wherein at least a portion of feeding the web material and at least a portion of ejecting the pressware product occur at the same time.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for producing pressware, comprising:

producing a pressware product between an upper forming die and a lower forming die contained within a forming die assembly;

retracting at least a portion of the upper forming die from the pressware product;

ejecting the pressware product laterally away from the lower forming die while feeding a web material between the upper forming die and the lower forming die, wherein the pressware product is ejected laterally away from the lower forming die and while disposed entirely below a plane of the web material being fed between the upper forming die and the lower forming die at the same time, wherein electing the pressware product further comprises moving at least a portion of the upper forming die and at least a portion of the lower forming die in opposite directions from one another;

cutting a segment of the web material to produce a substrate; and pressing the substrate between the upper forming die and the lower forming die to produce another pressware product.

2. The method of claim 1, wherein:

feeding the web material between the upper forming die and the lower forming die comprises moving the web material along an upper surface of a stationary platen, the stationary platen having a passageway extending therethrough, the pressware product is pressed while within the passageway, and the stationary platen is stationary relative to the upper forming die and the lower forming die.

3. The method of claim 1, wherein retracting at least the portion of the upper forming die from the pressware product comprises:

retracting a forming punch from the pressware product while contacting the pressware product with a pressure ring.

4. The method of claim 3, further comprising breaking contact between the pressure ring and the pressware product by:

moving the pressure ring away from the pressware product while supporting the pressware product stationary with the lower forming die;

moving the lower forming die supporting the pressware product away from the pressure ring while the pressure ring is stationary; or moving the pressure ring and the lower forming die supporting the pressware product away from each other.

5. The method of claim 1, wherein ejecting the pressware product from the lower forming die further comprises:

moving the lower forming die supporting the pressware product away from the upper forming die;

lifting the pressware product with at least a portion of the lower forming die; and exposing the pressware product to a gaseous flow to eject the pressware product from the portion of the lower forming die.

6. The method of claim 5, wherein the portion of the lower forming die is a lower knockout and the pressware product is ejected from the lower knockout while at a position entirely below the plane of the web material feeding between the upper forming die and the lower forming die.

7. The method of claim 1, wherein feeding the web material between the upper forming die and the lower forming die further comprises:

lifting a stripper plate from the web material;

feeding the web material; and indexing the web material to provide the segment of web material.

8. A method for producing pressware, comprising:

producing a pressware product between an upper forming die and a lower forming die contained within a forming die assembly;

retracting at least a portion of the upper forming die from the pressware product;

electing the pressware product laterally away from the lower forming die while feeding a web material between the upper forming die and the lower forming die, wherein the pressware product is elected laterally away from the lower forming die and while disposed entirely below a plane of the web material being fed between the upper forming die and the lower forming die at the same time;

cutting a segment of the web material to produce a substrate; and pressing the substrate between the upper forming die and the lower forming die to produce another pressware product, wherein the upper forming die and the lower forming die move in reciprocating and opposite directions perpendicular to the plane of the web material therebetween.

9. The method of claim 1, further comprising producing two or more pressware products per process cycle with two or more of the forming die assemblies disposed on a press assembly.

10. The method of claim 9, wherein the press assembly comprises three forming die assemblies to about twelve forming die assemblies.

11. The method of claim 10, wherein each forming die assembly produces 80 pressware products per minute to 120 pressware products per minute.

12. The method of claim 9, wherein the pressware products are plates, bowls, trays, or cutting boards and comprise paper, paperboard, pulp fiber, fibrous materials, plastic or polymeric materials, natural or synthetic materials, or any mixture thereof.

13. The method of claim 1, wherein the pressware product does not contact the web material when the pressware product ejects laterally away from the lower forming die while at a position entirely below a plane of the web material feeding between the upper forming die and the lower forming die.

14. A method for producing pressware, comprising:

pressing a substrate between an upper forming die and a lower forming die to produce a pressware product;

moving at least a first portion of the upper forming die away from the lower forming die;

moving at least a first portion of the lower forming die away from the upper forming die;

ejecting the pressware product laterally away from the lower forming die while feeding a web material between the upper forming die and the lower forming die, wherein the pressware product is ejected laterally away from the lower forming die and entirely below a plane of the web material being fed between the upper forming die and the lower forming die at the same time;

cutting a segment of the web material to produce another substrate; and pressing the produced substrate between the upper forming die and the lower forming die to produce another pressware product.

15. The method of claim 14, wherein moving at least the first portion of the upper forming die away from the lower forming die further comprises:

retracting a forming punch away from the pressware product while contacting the pressware product with a pressure ring.

16. The method of claim 15, further comprising retracting an upper knockout and the forming punch away from the pressware product while contacting the pressware product with the pressure ring.

17. The method of claim 16, wherein moving at least a first portion of the lower forming die away from the upper forming die further comprises:

retracting a contour rim and a lower knockout supporting the pressware product away from the pressure ring.

18. The method of claim 14, wherein ejecting the pressware product from the lower forming die further comprises:

moving the lower forming die supporting the pressware product away from the upper forming die;

lifting the pressware product with at least a lower knockout; and exposing the pressware product to a gaseous flow to eject the pressware product from the lower knockout, wherein the pressware product is ejected from the lower knockout while at a position entirely below the plane of the web material feeding between the upper forming die and the lower forming die.

19. The method of claim 14, wherein feeding the web material between the upper forming die and the lower forming die further comprises:

lifting a stripper plate from the web material;

feeding the web material; and indexing the web material to provide the segment of web material.

* * * * *